US010935262B2

(12) United States Patent
Duncan

(10) Patent No.: US 10,935,262 B2
(45) **Date of Patent: *Mar. 2, 2021**

(54) COOLING RECOVERY SYSTEM AND METHOD

(71) Applicant: Scot M. Duncan, Lake Forest, CA (US)

(72) Inventor: Scot M. Duncan, Lake Forest, CA (US)

( * ) Notice: Subject to any disclaimer, the term of this patent is extended or adjusted under 35 U.S.C. 154(b) by 228 days.

This patent is subject to a terminal disclaimer.

(21) Appl. No.: 15/489,598

(22) Filed: Apr. 17, 2017

(65) Prior Publication Data

US 2017/0219224 A1 Aug. 3, 2017

Related U.S. Application Data

(63) Continuation of application No. 13/854,866, filed on Apr. 1, 2013, now Pat. No. 9,638,472, which is a continuation of application No. 13/405,019, filed on Feb. 24, 2012, now Pat. No. 8,408,015, which is a continuation of application No. 11/852,225, filed on Sep. 7, 2007, now Pat. No. 8,151,579.

(51) Int. Cl.

| | |
|---|---|
| ***F28F 1/00*** | (2006.01) |
| ***F24F 3/153*** | (2006.01) |
| *F24F 3/14* | (2006.01) |

(52) U.S. Cl.

CPC ..... *F24F 3/153* (2013.01); *F28F 1/00* (2013.01); *F24F 2003/1452* (2013.01)

(58) Field of Classification Search

CPC ..... F24F 2003/1452; F24F 3/153; F28F 1/00
See application file for complete search history.

(56) References Cited

U.S. PATENT DOCUMENTS

| | | | |
|---|---|---|---|
| 2,160,389 | A | 5/1939 | Palmer |
| 2,200,118 | A | 5/1940 | Miller |
| 2,286,604 | A | 6/1942 | Crawford |
| 2,299,531 | A | 10/1942 | Crawford |
| 2,515,825 | A | 7/1950 | Grant |

(Continued)

FOREIGN PATENT DOCUMENTS

| | | | |
|---|---|---|---|
| JP | 59200140 | A2 | 11/1984 |
| JP | S61-76232 | U | 5/1986 |

(Continued)

OTHER PUBLICATIONS

Machine Translation of JP 2005-069552 to Kimuro, PAJ, Mar. 17, 2005. all pages, "Water Heat Source Heat Pump Unit."

(Continued)

*Primary Examiner* — Filip Zec
(74) *Attorney, Agent, or Firm* — Mintz Levin Cohn Ferris Glovsky and Popeo, P.C.

(57) ABSTRACT

A cooling recover system and method are disclosed. A fluid, such as water, is chilled and provided to a cooling coil to cool and dehumidify air passing over the cooling coil. The fluid is output from the cooling coil through an outlet, and at least a portion of the fluid from the outlet of the cooling coil is provided to an inlet of a heat transfer coil to reheat air passing over the heat transfer coil. The fluid is warmed as it passes through the cooling coil, which warmer temperature serves to reheat the air passing over the heat transfer coil.

22 Claims, 20 Drawing Sheets

(56) References Cited

U.S. PATENT DOCUMENTS

| | | | | |
|---|---|---|---|---|
| 2,928,260 | A | 3/1960 | Blum | |
| 3,625,022 | A | 12/1971 | Johnson | |
| 4,271,678 | A | 6/1981 | Liebert | |
| 4,380,910 | A | 4/1983 | Hood et al. | |
| 4,407,134 | A | 10/1983 | Snaper | |
| 4,427,055 | A | 1/1984 | Heavener | |
| 4,559,788 | A | 12/1985 | McFarlan | |
| 4,667,479 | A | 5/1987 | Doctor | |
| 4,920,756 | A | 5/1990 | Howland et al. | |
| 4,942,740 | A | 7/1990 | Shaw et al. | |
| 5,031,411 | A | 7/1991 | Gehring et al. | |
| 5,193,352 | A | 3/1993 | Smith et al. | |
| 5,337,577 | A | 8/1994 | Eiermann | |
| 5,390,505 | A | 2/1995 | Smith et al. | |
| 5,540,058 | A | 7/1996 | Yi et al. | |
| 5,607,011 | A * | 3/1997 | Abdelmalek | C10J 3/54 165/104.14 |
| 5,613,372 | A | 3/1997 | Beal et al. | |
| 5,816,066 | A | 10/1998 | Aoki et al. | |
| 5,953,926 | A | 9/1999 | Dressler et al. | |
| 6,260,366 | B1 | 7/2001 | Pan | |
| 6,269,650 | B1 | 8/2001 | Shaw | |
| 6,694,757 | B1 | 2/2004 | Backman | |
| 6,826,921 | B1 | 12/2004 | Uselton | |
| 6,976,365 | B2 | 12/2005 | Forkosh et al. | |
| 7,219,505 | B2 | 5/2007 | Weber et al. | |
| 8,151,579 | B2 | 4/2012 | Duncan | |
| 8,408,015 | B2 | 4/2013 | Duncan | |
| 8,534,346 | B1 * | 9/2013 | Mecozzi | F28F 9/001 165/54 |
| 9,638,472 | B2 | 5/2017 | Duncan | |
| 2003/0061822 | A1 | 4/2003 | Rafalovich | |
| 2004/0065099 | A1 | 4/2004 | Grabon et al. | |
| 2006/0218949 | A1 | 10/2006 | Ellis et al. | |
| 2014/0048244 | A1 * | 2/2014 | Wallace | F24F 11/89 165/253 |

FOREIGN PATENT DOCUMENTS

| | | | |
|---|---|---|---|
| JP | S61-89763 | U | 6/1986 |
| JP | S63-279035 | A | 11/1988 |
| JP | 7-233968 | A | 9/1995 |
| JP | H9-287797 | A | 11/1997 |
| JP | 2002 061903 | A | 2/2002 |
| JP | 2004012016 | A | 1/2004 |
| JP | 2005069552 | A | 3/2005 |
| JP | 2005207712 | A | 8/2005 |
| JP | 2005211742 | A * | 8/2005 |
| JP | 2006-177567 | A | 7/2006 |
| JP | 2006207856 | A | 8/2006 |
| JP | 2006292299 | A | 10/2006 |
| JP | 2007064556 | A | 3/2007 |

OTHER PUBLICATIONS

Machine Translation of JP 2004-012016, PAJ, Air Conditioner and its Operation and Method, description.

Notice of Reasons for Rejection in Japanese Application No. 2010 524203.

* cited by examiner

COOLING RECOVERY SYSTEM AND METHOD

CROSS-REFERENCE TO RELATED APPLICATION

This application is a continuation application of U.S. patent application Ser. No. 13/854,866 entitled "COOLING RECOVERY SYSTEM AND METHOD," filed Apr. 1, 2013, which claims priority to U.S. patent application Ser. No. 13/405,019, now U.S. Pat. No. 8,408,015 entitled "COOLING RECOVERY SYSTEM AND METHOD," and filed Feb. 24, 2012, which claims priority of U.S. patent application Ser. No. 11/852,225, now U.S. Pat. No. 8,151,579 entitled "COOLING RECOVERY SYSTEM AND METHOD," filed on Sep. 7, 2007, the disclosure of each is incorporated herein by reference in their entirety.

BACKGROUND

This disclosure relates generally to air conditioning in a facility, and more particularly to cooling, dehumidification, and heating systems and processes to reduce energy waste and reduce operating costs in facilities.

The environment of a facility, such as a residential, commercial, industrial or institutional building, is usually tightly controlled, as temperature and humidity must fall within a relatively narrow range to accommodate human comfort, health and safety. Mold, mildew and other biological growth can damage the facility and adversely affect its occupants, and cause extensive damage each year in many facilities. Biological growth particularly thrives in warm, moist areas. To reduce the potential for biological growth, facilities need to reduce the relative humidity of air within the facility. Thus, water is removed from the air in a process called dehumidification.

Conventional methods for humidity and temperature control in a facility are energy intensive, leading to high costs of operation of its cooling, dehumidification, and heating systems. Economizing either costs or energy often leads to improper use of such systems, defeating their purpose. Worse, misuse of cooling, dehumidification and heating systems permits biological growth. In humid climates, for example cooling systems may be left running twenty-four hours per day, seven days per week to reduce the potential for biological growth, even when the facility is unoccupied. This wastes substantial energy.

FIG. 1 is a schematic view of a prior art cooling, dehumidification and re-heat system 01-0001 that includes one or more air handling units (AHUs) 01-0003, valves 01-0055, 01-0080 and the like. A fluid such as water is typically cooled in a chiller plant 01-0040 and conveyed through chilled fluid supply piping 01-0045, 01-0090 towards the one or more AHUs 01-0003, and returned through chilled fluid return piping 01-0050, 01-0085 towards one or more of the chiller plants 01-0040. The cooled fluid is conveyed through the chilled fluid piping via one or more pumping units contained in the chiller plants 01-0040.

Fluid is heated in a heating plant 01-0035 and conveyed through heated fluid supply piping 01-0075, 01-0105 towards one or more temperature control zones 01-0065, and returned through heated fluid return piping 01-0070, 01-0110 toward one or more heating plants 01-0035. Typically, the heated fluid is conveyed through the heated fluid piping via one or more pumping units contained in the heating plants 01-0035.

The flow of chilled fluid to AHU 01-0003 is controlled by selectively modulating a flow control valve 01-0055. The heating source fluid is controlled by selectively modulating a flow control valve, 01-0080. The chilled fluid flow control valves 01-0055 are positioned downstream of the AHUs 01-0003, and the heating source fluid flow control valves 01-0080 are positioned downstream of heating coils 01-0030. Alternatively, the valves 01-0055, 01-0080 may be situated upstream of the AHU 01-0003 or upstream of the heating coils 01-0030, respectively.

Chilled fluid is used to condition air or to remove heat from one or more other sources. For example, chilled fluid is distributed through cooling coils 01-0015 or other heat exchange units of an AHU 01-0003. Fans 01-0060 or blowers receive unconditioned or partially conditioned air from an inlet source consisting of return air 01-0002 and fresh air 01-0005 mixed in varying proportions to create a mixed air stream 01-0010 and deliver it through one or more cooling coils 01-0015.

The mixed air stream 01-0010 is passed through a filter 01-0100, or it can remain unfiltered. As air moves past the cooling coils 01-0015, heat from the unconditioned or partially conditioned air is removed by the chilled fluid therein. When mixed air stream 01-0010 or conditioned space conditions 01-0171 require it, the conditioned air 01-0025 leaving the cooling coils 01-0015 is cooled to a point where water is removed from the air and the relative humidity in the conditioned spaces is maintained low enough to reduce the potential for biological growth.

Reducing the temperature of the conditioned air 01-0025 condenses moisture from the air, drying it. Thus, dry, cold conditioned air 01-0025 is delivered to individual offices, rooms or other locations within a facility's interior 01-0171 through a discharge duct 01-0020 or other conveyance system. The dry, cold conditioned air 01-0025 is usually too cold to meet comfort needs or process cooling loads for many of the spaces that require cooling and dehumidification, so the conditioned air 01-0025 is delivered to temperature control boxes 01-0065 that contain a heating coil 01-0030.

Warm or hot fluid can be used to condition air or to add heat to the air from one or more heating sources. For example, heated water can be distributed through heating coils 01-0030 or other heat exchange units of a temperature control box 01-0065. The temperature control box 01-0065 may be constant or variable volume. The temperature control box 01-0065 includes a control system that controls the control valve 01-0080 which controls the volume or pressure of the heated source fluid that is passed through the heating coil 01-0030. Heated fluid is generated in one or more heating plants 01-0035 and distributed to the temperature control zones 01-0065 through heating fluid supply piping 01-0075, 01-0105, and heating fluid return piping, 01-0070, 01-0110. The supply air temperature that leaves the heating coil 01-0030 and enters the spaces to be conditioned, either directly or through a distribution system 01-0170, is continuously varied to maintain the needs of the occupant or process cooling loads 01-0171 by selectively modulating a flow control valve 01-0080 to add heat to the cold dry dehumidified air.

As a result of the heat exchange at the cooling coils 01-0015, the temperature of the air 01-0010 passing thereover is decreased to remove moisture, while the temperature of the fluid passing therethrough increases to approximately 55° F. to 60° F., particularly during the summer months when dehumidification loads are typically present. This heated or spent chilled fluid can be collected in a separate spent fluid piping 01-0050, 01-0085 and delivered to the inlet of the chiller system 01-0040. In addition, as a result of the heat transfer from the unconditioned or partially conditioned air to the chilled water occurring at or near the cooling coils 01-0015, the process can also dehumidify the air.

In general, cooling coils require a chilled fluid supply via the chilled fluid piping from the chiller at a temperature of between 34° F. and 45° F. to meet peak cooling and dehumidification loads. Cooling coils typically provide fluid being returned through chilled fluid piping to a chiller at a temperature of between 55° F. and 60° F. The cooling coils are conventionally designed to provide a discharge air temperature of between 50° F. and 55° F., as required to meet comfort needs of occupants of the facility or the needs of the process cooling loads.

A maximum discharge air temperature of approximately 55° F. is usually used during dehumidification to reduce the water in the air stream entering the conditioned spaces of the facility. The minimum discharge air temperature may be as low as 40° F. to 45° F., as required by the load being served. The cooling coils are typically sized with a face velocity of 500 to 600 feet per minute, as calculated by dividing the air flow volume in cubic feet per minute (CFM) by the square footage of the face of the coil that air is passing through, although they can have lower and higher face velocities. Finally, the cooling coils are arranged with between four and eight rows of heat transfer tubing, but can have greater or less numbers of heat transfer rows.

Heating coils in such systems usually require a heated fluid supply temperature of between 150° F. and 200° F., supplied through heated fluid piping from heating plants, and a heated fluid return temperature of between 120° F. and 160° F. returned through heated fluid piping to the heating plants. The heating coils are designed to provide a discharge air temperature of between 60° F. and 110° F. A maximum discharge air temperature of approximately 110° F. is typically used to reduce the amount of hot air stratification that occurs when the heated air enters the conditioned space or process load, although higher temperatures can be used.

During dehumidification operation, the discharge air temperature may be 60° F. to 70° F., as heating of the space or process load might not be required. The heating coils are sized to accommodate a face velocity of 800 to 1,000 feet per minute, which is calculated by dividing the air flow volume in cubic feet per minute (CFM) by the square footage of the face of the coil that air is passing through. The heating coils are usually arranged in one, two, or more rows.

To reduce energy waste and operating costs, many facility operating engineers deemphasize dehumidification and operate the cooling system with higher air delivery temperatures. While this reduces the amount of re-heat energy that is required, and also reduces the cooling loads, dehumidification is reduced so that the air in the facility is at a higher relative humidity. Higher relative humidity levels can encourage biological growth.

There is also a compounding energy waste that occurs. Supply air temperature of around 55° F. is far too cold for occupant comfort in most climates during most of the year. Thus, the 55° F. supply air temperature is warmed up or "re-heated" to a temperature that meets the comfort criteria of the occupants or process cooling load.

The heating source for the re-heat process is usually a new source of energy. Electric heaters, radiant panels, and heating coils that use hot water generated by hot water heaters or boilers are the typical sources of heat for the re-heat process. The fuels for the boiler or hot water heater can be wood chips, natural gas, oil, coal, peat, or some other combustible fuel. The water can also be heated using electricity. Heat recovered from the condenser side of a cooling system may be used to warm up the air, but these systems are less common. Re-heat coils are installed downstream of the cooling coils in a system. They can either be located within the same housing as the cooling coil, or located remotely.

For most water-based re-heat systems, the re-heat coils require very high water temperatures—typically 150° F. to 200° F. These high water temperatures waste boiler or hot water heater energy, since boiler and hot water heater energy efficiency worsen as the water temperature increases. Re-heat energy adds cooling load to the facility, since most of the heat that is added to the air to meet comfort conditions or process cooling load needs is returned to the AHU system via the return air system. There is another compounding energy waste as heat is continually added to keep facility space comfortable, or to meet the process cooling requirement. But this same heat is removed from the air when dehumidifying the air by reducing the supply air temperature.

An alternative cooling, dehumidification and re-heat cycle is as follows: air is returned to the AHU where it is mixed with fresh air in varying proportions, now referred to as "mixed air." In many parts of the country for much of the year, the mixed air is warm and moist, and is reduced to a temperature of around 55° F. by a cooling system to dehumidify it, after which it is known as "supply air."

The supply air is re-heated in varying degrees, referred to as "re-heated air," to provide comfort to the occupants or meet process cooling load needs. The re-heated air is delivered to the occupied spaces or the process cooling loads. Additional heat is added to the air in the occupied spaces or by the process load to produce "warmed-up air." Once the warmed-up air leaves the conditioned spaces or the process load, it is referred to as "return air." The return air contains the heat generated in the conditioned spaces or by the process cooling load, as well as the heat imparted to the air during the re-heat process.

In a typical system, the water from the cooling coils is returned directly to the cooling system source, typically a chiller plant. The return chilled water carries most of the heat from the conditioned spaces, most of the heat from the process loads, the heat from the dehumidification process, the heat associated with cooling the fresh air that is brought into the system, and most of the heat from the re-heat system back to the chiller plant. The heat contained in the air that is exhausted from the facility and not returned to the chiller plant.

The return chilled water temperature leaving the cooling coils and being returned to the chiller plant is typically 55° F. to 60° F. during the summer months, when most dehumidification is required. The chiller plant takes this 55° F. to 60° F. water and cools it down, typically to 40° F. to 45° F. Once the water is cooled by the chiller plant, it is sent back out to the cooling coils to start the cooling and dehumidification process again. The 55° F. to 60° F. chilled water return temperature common from most cooling systems implementations is too cold to be used effectively as a source of heating.

With a conventional cooling system, the chillers are typically piped in parallel. Each chiller receives the same return water temperature and each chiller delivers the same supply water temperature. The chillers also receive the same condenser water temperature. As an example, when there are two chillers, the return water temperature to each chiller may be 60° F. and the supply water temperature from each chiller might be 44° F. The condenser water supply temperature in this example is 85° F. Assuming a constant load on each chiller, efficiency of a chiller is proportional to the temperature difference between the chilled water supply temperature and the condenser water supply temperature. The greater the temperature difference between the chilled water and condenser water temperatures, the poorer the chiller efficiency. Conversely, when the difference between the chilled water and condenser water temperatures is reduced, chiller efficiency is improved.

Under Floor Air Distribution Systems (UFADS) are a variation of the typical overhead air distribution system for air conditioning systems. A UFADS requires air be supplied to the floor grills at between 62° F. and 65° F. instead of 55° F. to reduce drafts and occupant discomfort. As with a "normal" air conditioning system, air should be cooled to around 55° F. to dehumidify it, then re-heated to the proper temperatures for occupant comfort. To reduce energy use, some operators have resorted to providing 62° F. to 65° F. supply air from the cooling coils, rather than dehumidifying the air down to 55° F. and then re-heating up to 62° F. to 65° F. This reduces the cooling loads, since re-heat is not required, and very little dehumidification is accomplished with these supply air temperatures, and so the dehumidification portion of the cooling load is also reduced.

Re-heat energy and cooling plant energy are both reduced when these strategies are employed, but many of the facilities eventually suffer from biological growth, and very expensive remediation efforts, whose costs far outweigh the energy savings benefits that results from the lack of dehumidification and re-heat, is sought.

SUMMARY

This document discloses systems and methods for using facility cooling, dehumidification and heaters to reduce the relative humidity in the facility, and to reduce the potential for biological growth in facilities that causes vast amounts of damage each year. The cooling recovery system design improves chiller plant efficiency, as well as reducing the loads that is served and the amount of re-heat energy that is expended.

In one aspect, an air conditioning system includes a cooling coil having an inlet to receive a fluid from a fluid chiller to cool and dehumidify air that passes over the cooling coil, and having an outlet to output the fluid. The air conditioning system further includes a fluid recovery conduit to receive the fluid from the outlet of the cooling coil, and a heat transfer coil having an inlet to receive the fluid to reheat air from the cooling coil that passes over the heat transfer coil.

In another aspect, a method for conditioning air includes the steps of chilling a fluid, providing the fluid to a cooling coil to cool air passing over the cooling coil, outputting the fluid from the cooling coil through an outlet, and providing at least a portion of the fluid from the outlet of the cooling coil to an inlet of a heat transfer coil to reheat air passing over the heat transfer coil. The fluid is warmed as it passes through the cooling coil, which warmer temperature serves to reheat the air passing over the heat transfer coil.

In another aspect, a method for conditioning air includes the steps of receiving, through a fluid recovery conduit connected to an outlet of a cooling coil, a fluid at a heat transfer coil, the fluid being warmed as it flows through the cooling coil. The method further includes the step of reheating, with the heat transfer coil, air that has been cooled and dehumidified by the cooling coil.

In yet another aspect, an air conditioning system includes a heat transfer coil having an inlet to receive a warmed fluid via a fluid recovery conduit connected to an outlet of a cooling coil. The heat transfer coil is adapted to reheat, with the warmed fluid, air that has been cooled and dehumidified by the cooling coil.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
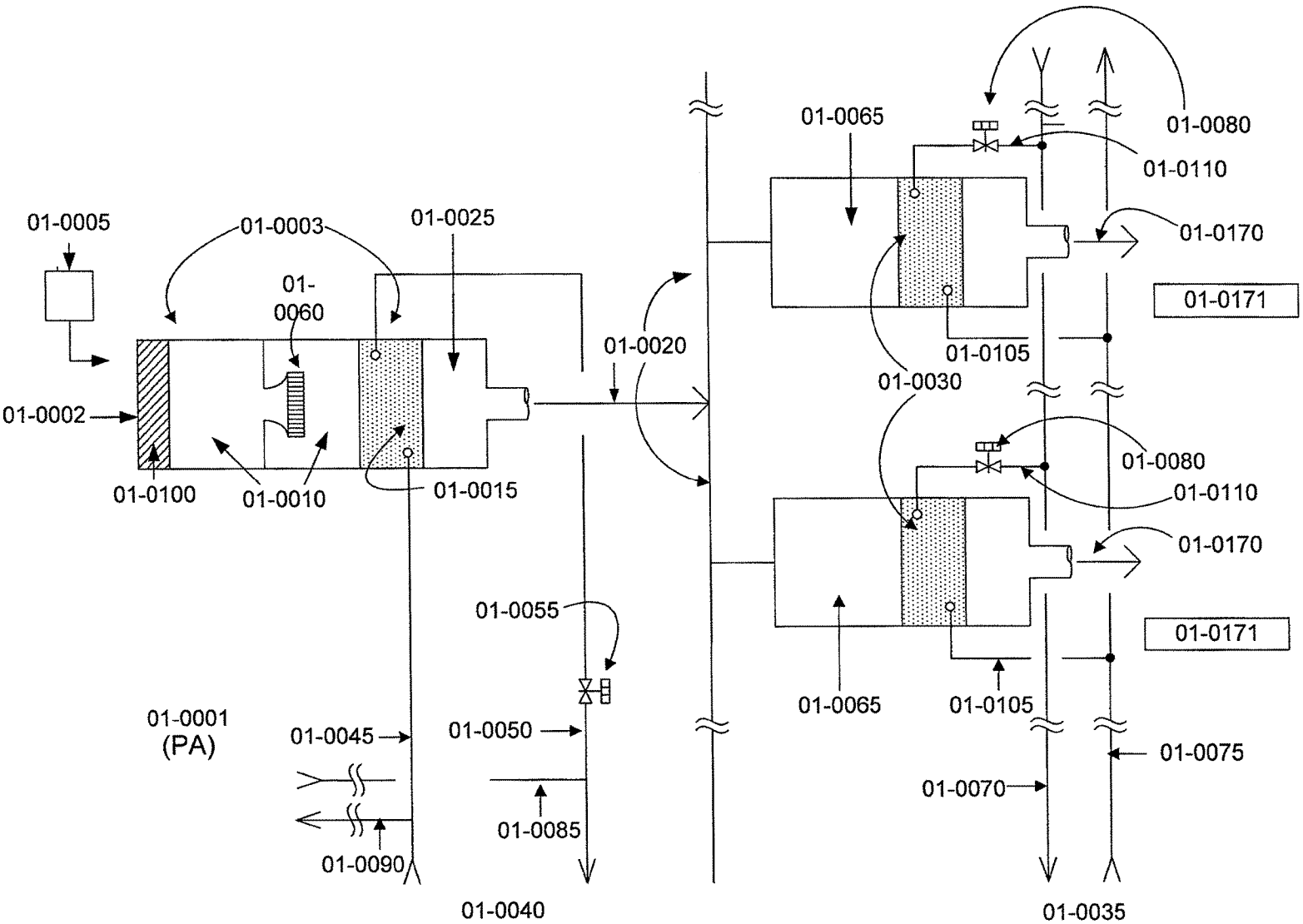
FIG. 1 is a schematic illustration of a prior art cooling, dehumidification and re-heat system.

This document describes systems and methods to substantially reduce the amount of energy required for the cooling and re-heating process of a facility's air conditioning system, through the use of a cooling recovery coil to re-heat air being delivered to a space of the facility or other process of the air conditioning system.

When dehumidification is required, but the dehumidified air is too cool for its intended end use, re-heating of the air is required. In some implementations, a cooling recovery coil system is used, rather than a heat recovery coil as is typical, to reduce the cooling loads by reducing the water temperature that is being returned to the cooling plant. The cooling recovery coil system also reduces the amount of re-heat that is used to maintain occupant comfort or process cooling conditions, by increasing the air temperature so that heating loads are reduced. During the cooling process, when a chilled water-based cooling system is used to provide the cooling source to the AHUs, cold water is supplied to cooling coils inside the AHUs to cool the air being circulated by an AHU for dehumidification and comfort cooling, or to meet process cooling loads.

Warm mixed air passes over these cooling coils, transferring the heat contained in the mixed air into the cold water being circulated through the cooling coils. During this process, the water temperature in the cooling coils increases, as the temperature of the air passing over the cooling coils is decreased. Heat is transferred from the air to the water indirectly through the cooling coil tubing. Some return air is exhausted from the facility, so the heat contained in the exhausted air is not transferred to the cooling coil system or the chiller plant.

In accordance with some implementations, the AHU cooling coil systems provide a higher than conventional return water temperature, typically 65° F. to 75° F. or higher during summer operation instead of the typical 55° F. to 60° F. temperature. The cooling coils are operated to provide approximately 55° F. supply air temperature, so that dehumidification still occurs.

The re-heat coil systems utilize a much lower supply water temperature, typically 65° F. to 75° F. to match the temperature of the chilled water leaving the cooling coils and being returned to the chiller plant in one or more coils referred to herein as a "cooling recovery coil." The cold, dehumidified air leaving the cooling coil at around 55° F. enters the cooling recovery coil. The cooling recovery coil contains chilled water entering the coil at 65° F. to 75° F. or higher. The warm water entering the cooling recovery coil provides heat to the cold, dehumidified air, warming it up.

The cold air entering the cooling recovery coil system draws heat from the water in the cooling recovery coil, reducing the temperature of the water being returned to the chiller plant. This reduces the cooling load that is served by the chiller plant in direct proportion to the percentage of the water temperature reduction, when compared with the temperature differential of the water without the cooling recovery coil. For example, a cooling recovery coil-based system operating with a 25° F. chilled water system temperature differential (assuming a 45° F. chilled water supply temperature and a 70° F. chilled water return temperature), and the cooling recovery coil drawing enough heat from the chilled water return to reduce the water temperature to 62° F., reduces the chiller plant load by approximately 32%: (70° F.-62° F./70° F.-45° F.)=8° F./25° F. The airstream is heated, and the chilled water return temperature is reduced. New energy required for the re-heat process or cooling energy required for the cooling process is less than conventional systems.

Piping and control systems are configured to reduce the energy consumption of the cooling, re-heat and heating processes over and above the savings offered by the cooling recovery process by itself. For example, when maximum heating or cooling loads are experienced, the system can use the entire heat transfer surface area of the cooling coil and cooling recovery coils as either a large heating coil, or a large cooling coil. The greater heat transfer surface area improves the efficiency of the heating and cooling systems as described below.

When peak comfort periods or process cooling loads exist (i.e. maximum cooling required), there is a reduced need for re-heat to raise the supply air temperature above 55° F. for many portions of a facility. In exemplary implementations, the cooling coil and cooling recovery coil are arranged and controlled in such a manner that the entire heat transfer surface area of the two coil systems—the cooling coil system and the cooling recovery coil system—can be used as a very large cooling coil. The added cooling coil heat transfer surface area allows a temperature of chilled water that is supplied to the AHU from the cooling plant to be increased. Increasing the chilled water supply temperature from a chiller increases the efficiency of the chiller system by 1% to 3% or more per degree the chilled water supply temperature is raised.

When peak comfort heating loads exist (i.e. maximum heating required), there is a reduced need for cooling to reduce the supply air temperature for cooling or dehumidification of many portions of a facility. During days in which heating is necessary, the need for dehumidification is typically very low. In some implementations, the cooling coil and cooling recovery coil are arranged and controlled such that the entire heat transfer surface area of the two coil systems—the cooling coil system and the cooling recovery coil system—can be used as one very large heating coil. This added heating coil heat transfer surface area allows the temperature of heating water supplied to the AHU from the heating plant to be decreased. The efficiency of the heater is increased by 1% or more for every five degrees the heating water supply temperature is reduced.

A cooling system of a conventional air conditioning arrangement can also be used as a cooling recovery coil system. With a cooling recovery coil, return water temperature is higher than with a conventional system. This allows the chillers to be arranged in series, as will be explained further below, with one chiller being upstream of the other chiller(s). The first chiller receives return chilled water at a temperature of 65° F. to 75° F., instead of 60° F. for conventional systems. This chiller then cools the water to 55° F. to 60° F., which is then supplied to the downstream chiller, which in turn delivers water of 44° F. to 45° F. The downstream chiller will have approximately the same efficiency as the chillers that were piped in parallel, since it is delivering chilled water at approximately the same temperature. However, the upstream chiller will have much better efficiency, since it is delivering much warmer chilled water (55° F. to 60° F.) versus 45° F. of conventional systems.

A cooling recovery coil is also used as an efficient heating coil when additional heat is required. The sizing of the cooling recovery coil allows comparatively low hot water temperatures to be used for heating, improving heater efficiency. Waste heat of very low quality can be effectively used to meet the re-heat or heating needs of a facility. In particular implementations, heating water temperatures of between 96° F. and 100° F. can provide heating air temperatures in excess of 95° F., where conventional heating and re-heat system designs require 150° F. to 200° F. hot water temperatures to produce 95° F. heating air temperatures.

If there is no source of 100° F. waste heat available, a new heating source is used. Typical hot water heating equipment is between 80% and 85% efficient when water temperatures of 150° F. to 200° F. are used. In accordance with some implementations, the sizing and design of the cooling recovery coil can allow 100° F. heating water to be used. At these comparatively low water temperatures, new condensing type hot water heaters are between 92% and 95% efficient, depending upon the load on the heaters. During non-peak heating load conditions, the efficiency of these boilers climbs to 96% to 98%.

Figure 2:
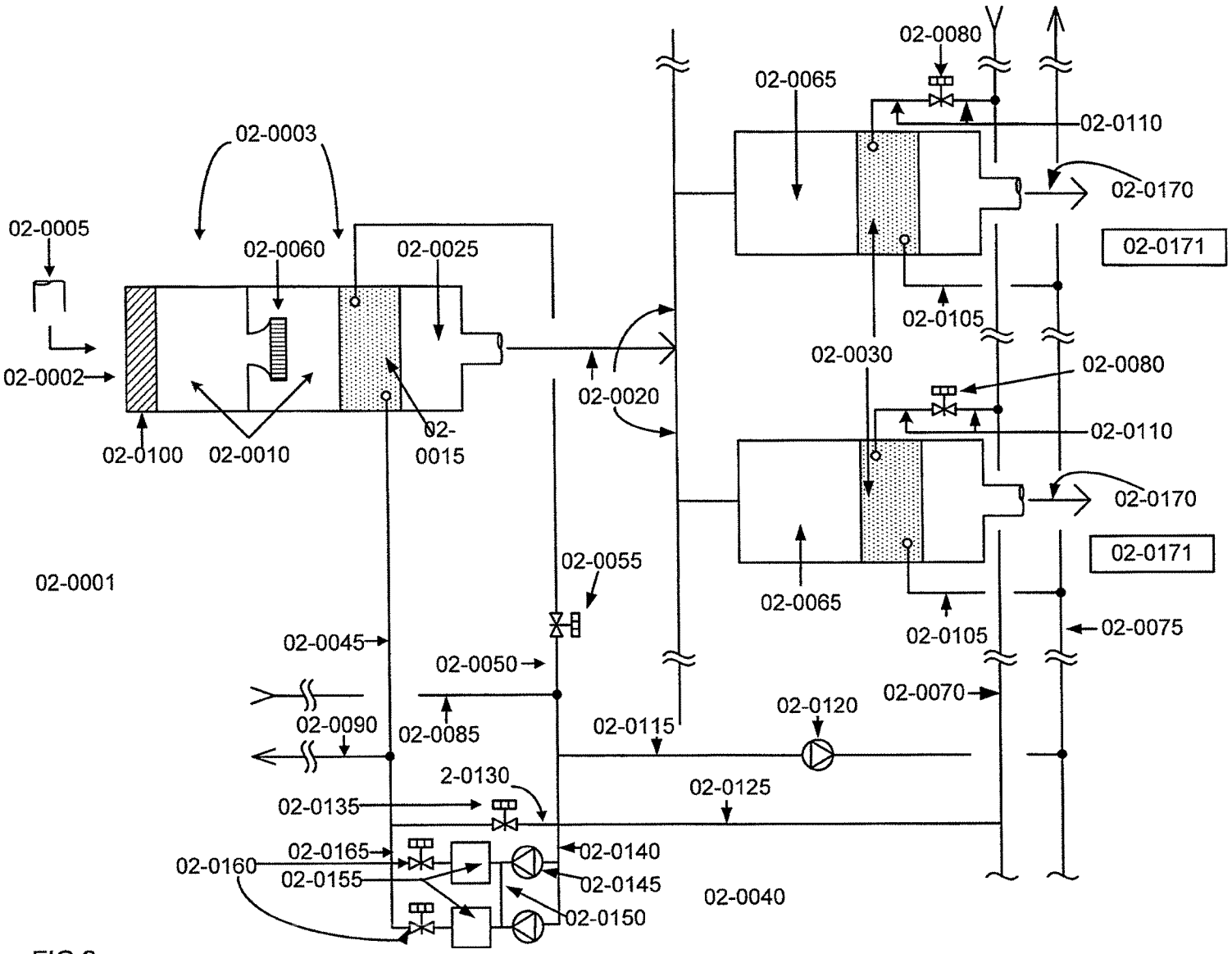
FIG. 2 is a schematic illustration of a cooling, dehumidification and re-heat system in accordance with an implementation.

FIG. 2 is a schematic illustration of a cooling, dehumidification and re-heat system 02-0001 in which the cooling recovery coils are located remotely from the AHU or fan coils, and cooling recovery is the main source of re-heat energy. In accordance with this implementation, the system 02-0001 includes one or more AHUs 02-0003 and one or more valves 02-0055, 02-0080. Fluid is cooled in cooling plants 02-0040 and conveyed through chilled fluid supply piping 02-0045, 02-0090 towards the one or more AHUs 02-0003, and returned through chilled fluid return piping 02-0050, 02-0085 towards one or more chillers 02-0040.

Cooled fluid is conveyed through chilled fluid piping by one or more pumps contained in the cooling plants 02-0040. Fluid is heated in cooling coil 02-0015 and conveyed through a heated fluid return piping 02-0050, 02-0085 towards cooling plants 02-0040. This heated fluid is returned to one or more cooling plants 02-0040. Prior to entering a cooling plant 02-0040, heated fluid is withdrawn in the amount required to reheat discharge air 02-0025. Pumping system 02-0120 and piping system 02-0115 are used to convey heated water from the cooling coil systems 02-0015 to heated fluid supply piping systems 02-0075, 02-0105 towards one or more temperature control zones 02-0065, and returned through heated fluid return piping 02-0070, 02-0110 towards one or more cooling plants 02-0040 through piping system 02-0125. The fluid being transported to and from the reheat coil system has heat removed from it during the reheat process, reducing the load on the cooling plant and heating system simultaneously.

The flow of chilled fluid to an AHU 02-0003 is controlled by selectively modulating flow control valve 02-0055. The heating source fluid is controlled by selectively modulating flow control valve 02-0080. As illustrated in FIG. 2, the chilled fluid flow control valve 02-0055 is positioned downstream of the AHUs 02-0003, and may include one or more valves. Each heating source fluid flow control valves 02-0080 is positioned downstream of the heating coils (i.e. cooling recovery coils) 02-0030. Alternatively, the valves 02-0055 and 02-0080 may be situated upstream of an AHU 02-0003 and/or upstream of the heating coils (cooling recovery coils) 02-0030.

Chilled fluid is used to condition air or to remove heat from one or more other sources. For example, chilled water is distributed through cooling coils 02-0015 or other heat exchange units of AHU 02-0003. Fans 02-0060 or blowers can receive unconditioned or partially conditioned air from an inlet source of return air 02-0002 mixed in varying proportions with fresh air 02-0005 to create a mixed air stream 02-0010, to be delivered through one or more cooling coils 02-0015. The air stream can either be passed through a filtration system 02-0100 or it can be unfiltered.

Chilled fluid conveyed through cooling coils 02-0015 removes heat from the unconditioned or partially conditioned air passing over the cooling coils 02-0015. When mixed air 02-0010 or conditioned space conditions 02-0171 require, the conditioned air 02-0025 leaving the cooling coils 02-0015 is cooled to where water is removed from the air and the relative humidity in the conditioned spaces is maintained low enough to reduce the potential for biological growth. Reducing the temperature of the conditioned air 02-0025 condenses moisture from the air, drying it out. Thus, dry, cold conditioned air 02-0025 is delivered to individual offices, rooms or other locations within a facility 02-0171 through a discharge duct 02-0020 or other conveyance system. The dry, cold conditioned air 02-0025 will typically be too cold to meet comfort needs or process cooling loads for many of the spaces that require cooling and dehumidification, so the conditioned air 02-0025 is delivered to temperature control boxes 02-0065 that contain a heating coil (cooling recovery coil) 02-0030.

Warm or hot fluid is used to condition air or to add heat to the air from one or more heating sources. For example, heated water can be distributed through heating coils 02-0030 or other heat exchange units of temperature control box 02-0065, which may be constant or variable volume. The temperature control box 02-0065 includes a controller that controls the control valve 02-0080, which in turn controls the volume or pressure of the heated source fluid being passed through the heating coil 02-0030. Heated fluid is generated in one or more heating plants 02-0035 or the cooling coils in a cooling recovery coil system, and distributed to temperature control zones 02-0065 via heating fluid supply piping 02-0075, 02-0105 and heating fluid return piping, 02-0070, 02-0110. The supply air temperature leaving the heating coil (cooling recovery coil) 02-0030 enters the spaces to be conditioned directly, or through a distribution system 02-0170 that is continuously varied to maintain the needs of occupants or process cooling loads 02-0171 by selectively modulating a flow control valve 02-0080 to add heat to the cold, dry dehumidified air.

As a result of the heat exchange at the cooling coils 02-0015, the temperature of the fluid passing therethrough increases to approximately 65° F. to 75° F. or higher when dehumidification loads are present. This heated or spent chilled fluid is collected in separate spent fluid piping 02-0050, 02-0085 and delivered to the inlet of the chiller 02-0040. Or, if there is a need for re-heating of some or all of the air that has been cooled and dehumidified, the spent chilled fluid is drawn into the cooling recovery coil chilled water piping 02-0115 by operating chilled water cooling recovery pumping system 02-0120, and discharging the warm chilled water return into the cooling recovery coil heating water supply lines 02-0075, 02-0105 for delivery to the cooling recovery coils as the heating source for the cooling recovery coils.

The main components within the chiller plant systems 02-0040 are as follows: 02-0140 is the chilled fluid return piping inside the chiller plant systems, and is the piping where all of the various fluid streams mix and become one common fluid stream. The fluid is returned from the cooling loads imposed by the AHUs or process cooling loads 02-0003 through the chilled fluid piping 02-0085, 02-0050, and mixed with the fluid returning from the cooling recovery coil systems through piping system 02-0125 and with the fluid from the bypass piping 02-0130. The mixed fluid is then drawn into the chilled fluid pumping systems 02-0145.

The chilled fluid pumping systems are provided in a draw-through or push-through configuration with the chillers 02-0155. The warm mixed fluid is then passed through the chiller systems 02-0155 where the fluid temperature is reduced. The chiller isolation valves 02-0160 are controlled to allow flow through the chillers. The chilled fluid then enters a common discharge piping 02-0165 where it is either delivered to the cooling loads through the supply piping 02-0090, 02-0045, or is returned to the chilled fluid return piping 02-0140 by passing through the chilled fluid bypass piping 02-0130 and bypass piping control valve 02-0135. FIG. 2 shows the chillers piped in one arrangement. Those having ordinary skill in the art can appreciate that alternative piping configurations can be used, as will be described further.

Figure 3:
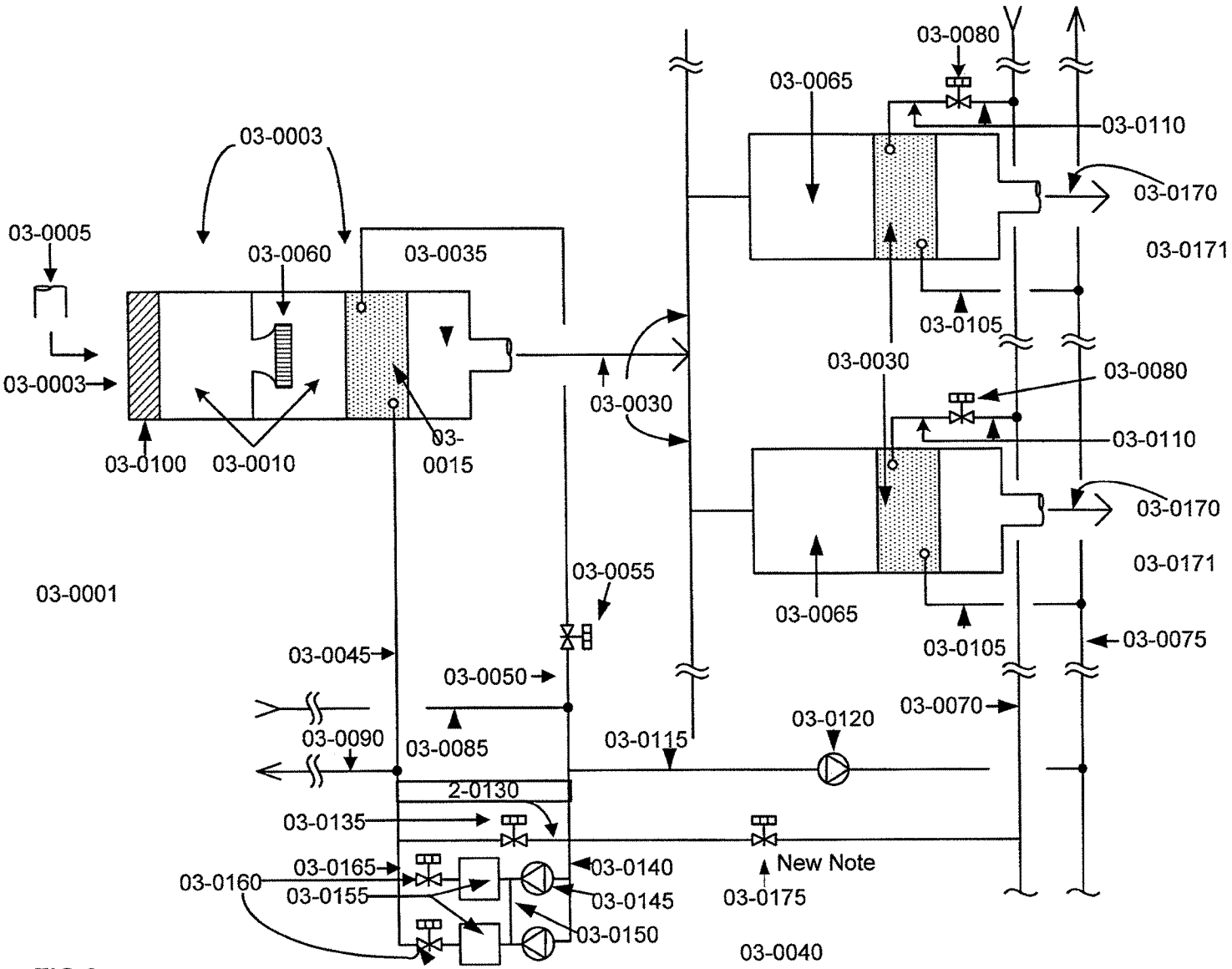
FIG. 3 is a schematic illustration of a cooling, dehumidification and re-heat system in accordance with an alternative implementation.

FIG. 3 is similar to FIG. 2, but includes a positive shutoff isolation valve 03-0175, to ensure that the cooling system and heater fluids do not mix when they are both in operation and the cooling recovery coil systems is not being used. A cooling, dehumidification and re-heat system 03-0001 includes one or more AHUs 03-0003, valves 03-0055, 03-0080 and the like. Fluid is cooled in a chiller system 03-0040 and conveyed through a chilled fluid supply piping 03-0045, 03-0090 towards one or more AHUs 03-0003, and returned through the chilled fluid return piping 03-0050, 03-0085 towards one or more chiller systems 03-0040. The cooled fluid is conveyed through the chilled fluid piping via one or more pumping units contained in the chiller systems 03-0040. Fluid is heated in a heater 03-0035 and conveyed through a heated fluid supply piping 03-0075, 03-0105 towards one or more temperature control zones 03-0065, and returned through the heated fluid return piping 03-0070, 03-0110 towards one or more heaters 03-0035. The heated fluid is conveyed through the heated fluid piping via one or more pumping units contained in the heaters 03-0035.

The flow of chilled fluid to an AHU 03-0003 is controlled by selectively modulating a flow control valve 03-0055. The heating source fluid is controlled by selectively modulating a flow control valve, 03-0080. As shown in FIG. 3, chilled fluid flow control valves 03-0055 are positioned downstream of respective AHUs 03-0003. The heating source fluid flow control valves 03-0080 are positioned downstream of respective heating coils (cooling recovery coils) 03-0030. Alternatively, the valves 03-0055, 03-0080 may be situated upstream of an AHU 03-0003 or upstream of respective heating coils (cooling recovery coils) 03-0030.

Chilled fluid is used to condition air or to remove heat from one or more other sources. For example, chilled water can be distributed through cooling coils 03-0015 or other heat exchange units of an AHU 03-0003. Fans 03-0060 or blowers receive unconditioned or partially conditioned air from an inlet source consisting of return air 03-0002 and fresh air 03-0005 mixed in varying proportions, to create a mixed air stream 03-0010 and deliver it through one or more cooling coils 03-0015. The air stream can either be passed through a filtration system 03-0100 or it can be unfiltered.

As air moves past the cooling coils 03-0015, chilled fluid therein removes heat from the unconditioned or partially conditioned air. When mixed air 03-0010, or conditioned space conditions 03-0171 require, the conditioned air 03-0025 leaving the cooling coils 03-0015 is cooled to the point that water is removed from the air, and the relative humidity in the conditioned spaces is maintained low enough to reduce the potential for biological growth. Reducing the temperature of the conditioned air 03-0025 condenses moisture from the air, drying it out. Thus, dry, cold conditioned air 03-0025 is delivered to individual offices, rooms or other locations within a facility's interior 03-0171 through a discharge duct 03-0020, or other conveyance system.

The dry, cold conditioned air 03-0025 may be too cold to meet comfort needs or process cooling loads for many of the spaces that require cooling and dehumidification, so the conditioned air 03-0025 is delivered to temperature control boxes 03-0065 that contain a heating coil 03-0030. Warm or hot fluid is used to condition air or to add heat to the air from one or more heating sources. For example, heated water can be distributed through heating coils (cooling recovery coils) 03-0030 or other heat exchange units of a temperature control box 03-0065. The temperature control box 03-0065 includes a controller that controls the control valve 03-0080, which in turn controls the volume or pressure of the heated source fluid that is passed through the heating coil 03-0030.

Heated fluid is generated in a heating plant or plants 03-0035 and distributed to the temperature control zones 03-0065 through heating fluid supply piping 03-0075, 03-0105, and heating fluid return piping, 03-0070, 03-0110. The supply air temperature that leaves the heating coil 03-0030 enters the spaces to be conditioned, either directly or through a distribution system 03-0170. The supply air temperature is continuously varied to maintain the needs of the occupant or process cooling loads 03-0171 by selectively modulating a flow control valve 03-0080 to add heat to the cold dry dehumidified air.

As a result of the heat exchange occurring at the cooling coils 03-0015, the temperature of the fluid passing therethrough increases to approximately 65° F. to 75° F. or higher during the summer months when dehumidification loads are usually present. As illustrated in FIG. 3, this heated or spent chilled fluid is collected in a separate spent fluid piping 03-0050, 03-0085 and delivered to the inlet of the chiller system 03-0040. If there is a need for re-heating of some or all of the air that has been cooled and dehumidified, some or all of the heated or spent chilled fluid that has been collected in the separate spent fluid piping 03-0050, 03-0085 is drawn into the cooling recovery coil chilled water piping 03-0115 by operating the chilled water cooling recovery pumping system 03-0120, and discharging the warm chilled water return into the cooling recovery coil heating water supply lines 03-0075, 03-0105 for delivery to the cooling recovery coils as the heating source for the cooling recovery coils.

The main components within the chiller plant systems 03-0040 are as follows: 03-0140 is the chilled fluid return piping inside the chiller plant systems, and is the piping where all of the various fluid streams mix and become one common fluid stream. The fluid is returned from the cooling loads imposed by the AHUs or process cooling loads 03-0003, through the chilled fluid piping 03-0085, 03-0050, and mixed with the fluid returning from the cooling recovery coil systems and the fluid from the bypass piping 03-0130. The mixed fluid is then drawn into the chilled fluid pumping systems 03-0145.

The chilled fluid pumping systems is provided in a draw-through or push-through configuration with the chillers 03-0155. The warm mixed fluid is then passed through the chiller systems 03-0155 where the fluid temperature is reduced. The chiller isolation valves 03-0160 are controlled to allow flow through the chillers that are operational. The chilled fluid then enters a common discharge piping 03-0165, where it is either delivered to the cooling loads through the supply piping 03-0090, 03-0045, or is returned to the chilled fluid return piping by passing through the chilled fluid bypass piping 03-0130 and bypass piping control valve 03-0135. FIG. 3 shows the chillers piped in one arrangement, although other arrangements are possible.

Figure 4:
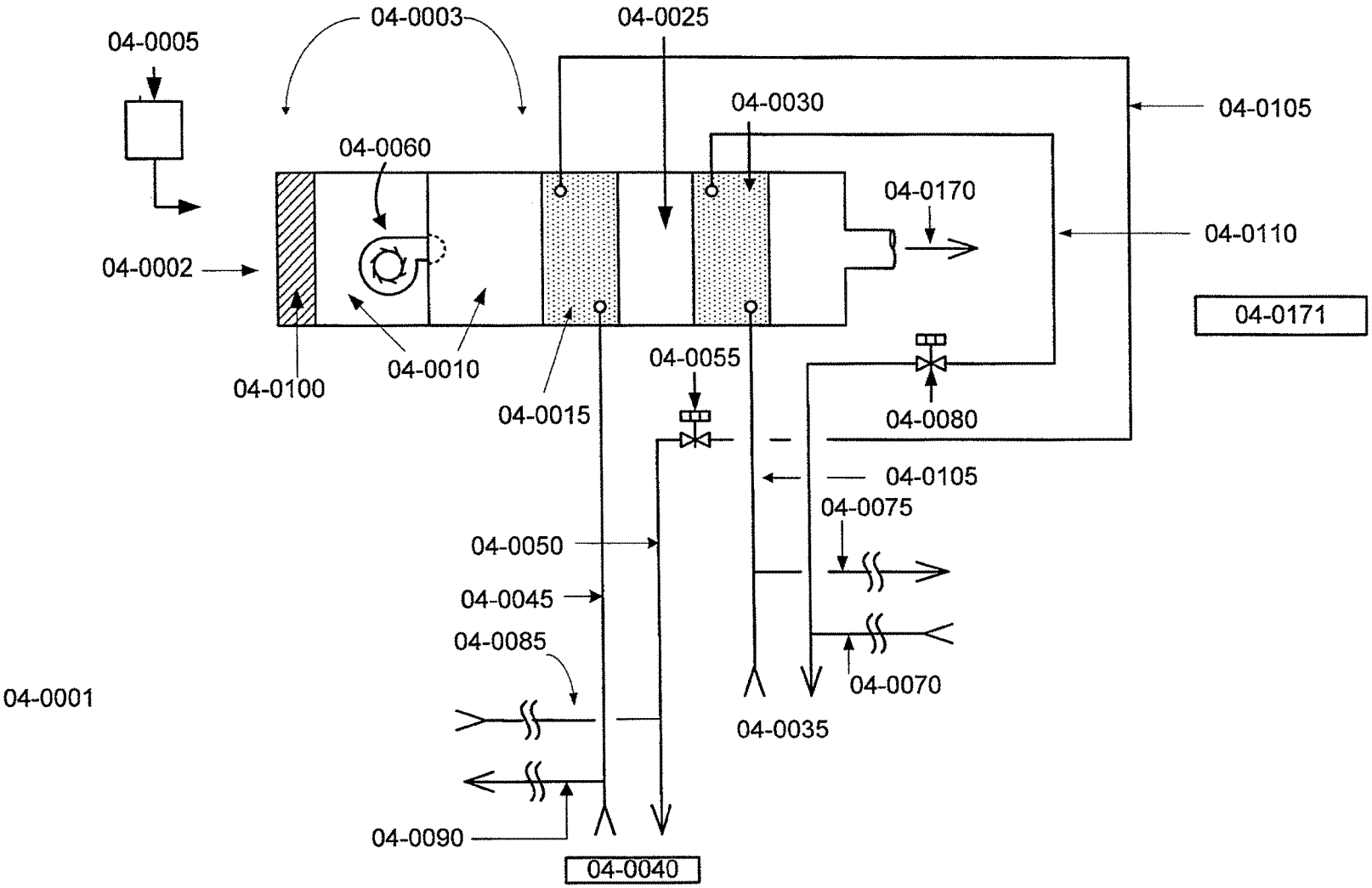
FIG. 4 is a schematic illustration of an alternative prior art cooling, dehumidification and re-heat system.

FIG. 4 shows a cooling, dehumidification and re-heat system 04-0001 that includes one or more AHUs 04-0003, valves 04-0055, 04-0080 and the like. Fluid is cooled in a chiller system 04-0040 and conveyed through a chilled fluid supply piping 04-0045, 04-0090 towards one or more AHUs 04-0003, and returned through the chilled fluid return piping 04-0050, 04-0085 towards one or more chiller systems 04-0040. The cooled fluid is conveyed through the chilled fluid piping via one or more pumping units contained in the chiller systems 04-0040. In some embodiments, fluid is heated in a heating plant 04-0035 and conveyed through a heated fluid supply piping 04-0075, 04-0105 towards one or more heating coil systems 04-0030, and returned through the heated fluid return piping 04-0070, 04-0110 towards one or more heating plants 04-0035. The heated fluid is conveyed through the heated fluid piping via one or more pumping units contained in the heating plants 04-0035.

The flow of chilled fluid to a cooling coil 04-0015 in an AHU 04-0003 is controlled by selectively modulating a flow control valve 04-0055. The heating source fluid is controlled by selectively modulating a flow control valve, 04-0080. As shown in FIG. 4, the chilled fluid flow control valves 04-0055 are positioned downstream of respective cooling coil 04-0015. The heating source fluid flow control valves 04-0080 are positioned downstream of the heating coils, 04-0030 respectively. Alternatively, however, the valves 04-0055, 04-0080 may be situated upstream of the cooling coil 04-0015 or upstream of the heating coils, 04-0030 respectively.

Chilled fluid is used to condition air or to remove heat from one or more other sources. For example, chilled water can be distributed through cooling coils 04-0015 or other heat exchange units of an AHU 04-0003. Fans 04-0060 or blowers can receive unconditioned or partially conditioned air from an inlet source of return air 04-0002 and fresh air 04-0005 mixed in varying proportions to create a mixed air stream 04-0010, and deliver the mixed air stream 04-0010 through one or more cooling coils 04-0015. The mixed air stream 04-0010 can either be passed through a filtration system 04-0100 or it can be unfiltered.

As air moves past the cooling coils 04-0015, chilled fluid therein removes heat from the unconditioned or partially conditioned air. When the mixed air stream 04-0010 or conditioned space conditions 04-0171 require it, the conditioned air 04-0025 leaving the cooling coils 04-0015 is cooled to a point where water is removed from the air and the relative humidity in the conditioned spaces is maintained low enough to reduce the potential for biological growth. Reducing the temperature of the conditioned air 04-0025 will condense moisture from the air, drying it out. Thus, dry, cold conditioned air 04-0025 is delivered to individual offices, rooms or other locations within a facility's interior 04-0171 through a discharge duct 04-1070, or other conveyance system. The dry, cold conditioned air 04-0025 will typically be too cold to meet comfort needs or process cooling loads for many of the spaces that require cooling and dehumidification, so the conditioned air 04-0025 is passed through a heating coil 04-0030.

Warm or hot fluid is used to condition air or to add heat to the air from one or more heating sources. For example, heated water can be distributed through heating coils 04-0030 or other heat exchange units of AHU 04-0003. The AHU 04-0030 may be constant or variable volume. The AHU 04-0003 includes a control system that controls the control valve 04-0080, which in turn controls the volume or pressure of the heated source fluid that is passed through the heating coil 04-0030. Heated fluid is generated in one or more heating plants 04-0035 and distributed to the AHU heating coil 04-0030 through heating fluid supply piping 04-0075, 04-0105 and heating fluid return piping 04-0070, 04-0110. The supply air temperature that leaves the heating coil 04-0030 enters the spaces to be conditioned, either directly or through distribution system 04-0170, is continuously varied to maintain the needs of the occupant or process cooling loads 04-0171 by selectively modulating a flow control valve 04-0080 to add heat to the cold dry dehumidified air.

As a result of the heat exchange occurring at the cooling coils 04-0015 the temperature of the air 01-0010 passing thereover is decreased to remove moisture, while the temperature of the fluid passing therethrough increases to approximately 55° F. to 60° F. during the summer months. As illustrated in FIG. 4, this heated or spent chilled fluid is collected in a separate spent fluid piping 04-0050, 04-0085 and delivered to the inlet of the chiller system 04-0040. As a result of the heat transfer from the unconditioned or partially conditioned air to the chilled water at or near the cooling coils 04-0015, the process can also dehumidify the air.

The cooling coils 04-0015 provide fluid of between 34° F. and 45° F. being supplied through the chilled fluid piping 04-0045, 04-0090 from the chiller systems 04-0040 to meet peak cooling and dehumidification loads. The cooling coils 04-0015 provide a chilled fluid return temperature of between 55° F. and 60° F., being returned through the chilled fluid piping 04-0050, 04-0085 to the chiller systems 04-0040. Chilled fluid supply temperature of less than 34° F. and greater than 45° F. can be used in different implementations, and as cooling and dehumidification needs dictate.

The cooling coils 04-0015 provide a discharge air temperature 04-0025 of between 50° F. and 55° F., as required to meet comfort needs or the needs of the process cooling loads. A maximum discharge air temperature of approximately 55° F. is typically used when dehumidification is required to reduce the amount of water contained in the air stream that enters the conditioned spaces. The minimum discharge air temperature may be as low as 40° F. to 45° F., as required by the load being served.

The cooling coils 04-0015 are sized with a face velocity of 500 to 600 feet per minute, although lower or higher face velocities can be used. The cooling coils 04-0015 are sized for between 4 and 8 rows of heat transfer tubing, although higher or lower row counts can be used. The heating coils 04-0030 typically require a heated fluid supply temperature of between 150° F. and 200° F. being supplied through the heated fluid piping 04-0075, 04-0105 from the heating plants 04-0035. The heating coils 04-0030 provide a heated fluid return temperature of between 120° F. and 160° F., being returned through the heated fluid piping 04-0070, 04-0110 to the heating plant 04-0035.

The heating coils 04-0030 provide a discharge air temperature of between 60° F. and 110° F., as required to meet comfort needs or the needs of the process heating loads. A maximum discharge air temperature of approximately 110° F. is used to reduce the amount of hot air stratification that occurs when the heated air enters the conditioned space or process load. During dehumidification operation, the discharge air temperature may be 60° F. to 70° F., as heating of the space or process load might not be required. The heating coils 04-0030 are sized with a face velocity of 800 to 1,000 feet per minute although in this implementation the heating and cooling coils may have the same face velocity. The heating coils 04-0030 are sized for one to two rows of heat transfer tubing, although other numbers of rows of heat transfer tubing can be used.

Figure 5:
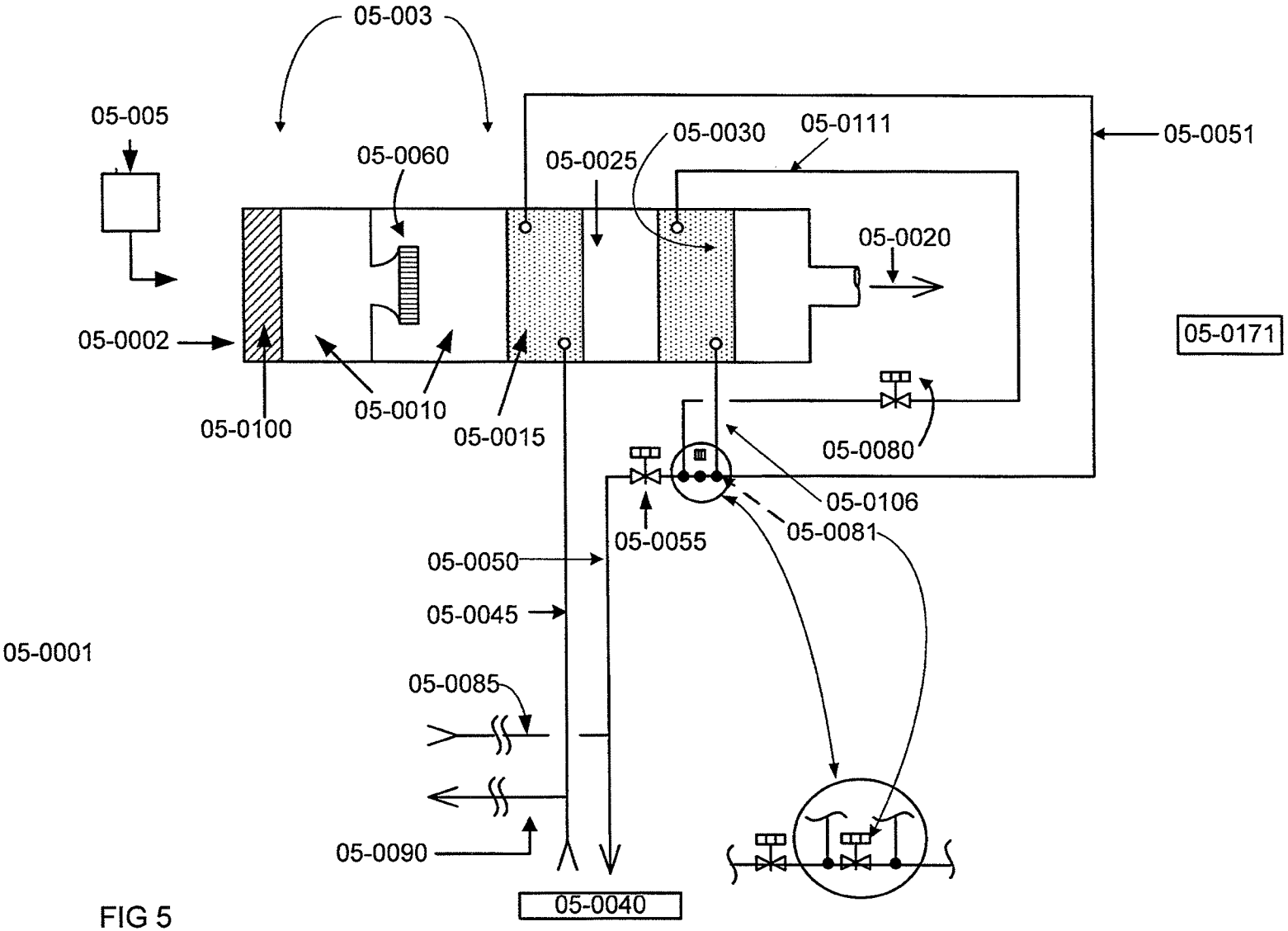
FIG. 5 is a schematic illustration of a cooling, dehumidification and re-heat system in accordance with an alternative implementation.

FIG. 5 is a schematic view of a cooling, dehumidification and re-heat system in accordance with a cooling recovery system design where the cooling recovery coils are located in close proximity to the cooling coils, and may be within the AHU or fan coil system. Recaptured energy from the cooling recovery coil system would be the primary re-heat source, and there may or not be additional heating coils located remotely from the AHU or fan coil to further temper the air. FIG. 5 does not include the details associated with a re-heat coil system located downstream of the cooling recovery coils, as those details are shown in other figures.

A cooling, dehumidification and re-heat system 05-0001 includes one or more AHUs 05-0003, valves 05-0055, 05-0080, 05-0081 and the like. In some embodiments, fluid is cooled in a chiller system 05-0040 and conveyed through a chilled fluid supply piping 05-0045, 05-0090 towards one or more AHUs 05-0003, and returned through the chilled fluid return piping 05-0050, 05-0085 towards one or more chiller systems 05-0040. The cooled fluid is conveyed through the chilled fluid piping via one or more pumping units contained in the chiller systems 05-0040. In this embodiment, the cooling recovery coil system 05-0030 is located in close proximity to the cooling coil 05-0015, and may be installed within the AHU 05-0003. In some embodiments, there may be an additional heating coil system located either within the AHU 05-0003 or remotely in the air stream downstream of the cooling recovery coil.

The flow of chilled fluid to an AHU 05-0003 is controlled by selectively modulating a flow control valve 05-0055. The cooling recovery source fluid is controlled by selectively modulating flow control valves, 05-0080, 05-0081. The chilled fluid flow control valves 05-0055 are positioned downstream of respective AHUs 05-0003. The cooling recovery source fluid flow control valves 05-0080, 05-0081 are positioned downstream of respective cooling recovery coils 05-0030. Alternatively, the valves 05-0055, 05-0080, 05-0081 may be situated upstream of an AHU 05-0003 or upstream of the cooling recovery coils 05-0030, respectively.

Chilled fluid is used to condition air or to remove heat from one or more other sources. For example, chilled water can be distributed through cooling coils 05-0015 or other heat exchange units of an AHU 05-0003. Fans 05-0060 or blowers can receive unconditioned or partially conditioned air from an inlet source, consisting of return air 05-0002, and fresh air 05-0005 mixed in varying proportions, to create a mixed air stream 05-0010, and deliver the mixed air stream 05-0010 through one or more cooling coils 05-0015. The air stream can either be passed through a filtration system 05-0100, or it can be unfiltered.

As air moves past the cooling coils 05-0015, chilled fluid therein removes heat from the unconditioned or partially conditioned air. When mixed air 05-0010, or conditioned space conditions 05-0171 require it, the conditioned air 05-0025 leaving the cooling coils 05-0015 is cooled to where water is removed from the air and the relative humidity in the conditioned spaces is maintained low enough to reduce the potential for biological growth. Reducing the temperature of the conditioned air 05-0025 will condense moisture from the air, drying it out. Thus, dry, cold conditioned air 05-0025 is delivered to individual offices, rooms or other locations within a facility's interior 05-0171 through a discharge duct 05-0020, or other conveyance system.

The dry, cold conditioned air 05-0025 will typically be too cold to meet comfort needs or process cooling loads for many of the spaces that require cooling and dehumidification, so the conditioned air 05-0025 is passed through a cooling recovery coil system 05-0030. Warm fluid from the chilled water return piping 05-0051 and leaving the cooling coil system 05-0015 is used to add heat to the air to reduce the need for heat from other heating sources, or to entirely meet re-heat needs. The supply air temperature that leaves the cooling recovery coil 05-0030, and which enters the spaces to be conditioned either directly or through a distribution system 05-0020, is continuously varied to maintain the needs of the occupant or process cooling loads 05-0171 by selectively modulating flow control valves 05-0080, 05-0081 to add heat to the cold dry dehumidified air. As stated previously, there may be addition heating coils located downstream of the cooling recovery coil system that are not shown FIG. 5.

As a result of the heat exchange occurring at the cooling coils 05-0015, the temperature of over-passing air 05-0010 is decreased to remove moisture, while the temperature of the fluid passing therethrough increases to approximately 65° F. to 75° F. or higher during the summer months. This heated or spent chilled fluid is collected in a separate spent fluid piping 05-0051, and delivered to the inlet piping 05-0106 for the cooling recovery coil system 05-0030 or returned to the chiller system 05-0040. If there is a need for re-heating some or all of cooled and dehumidified air 05-0025, some or all of the heated or spent chilled fluid that has been collected in the separate spent fluid piping 05-0051 is forced into the cooling recovery coil chilled water piping 05-0106 by operating control valves 05-0080, 05-0081, forcing the warm chilled water return into the cooling recovery coil heating water supply lines 05-0106 for delivery to the cooling recovery coils as the heating source for the cooling recovery coils.

Figure 6:
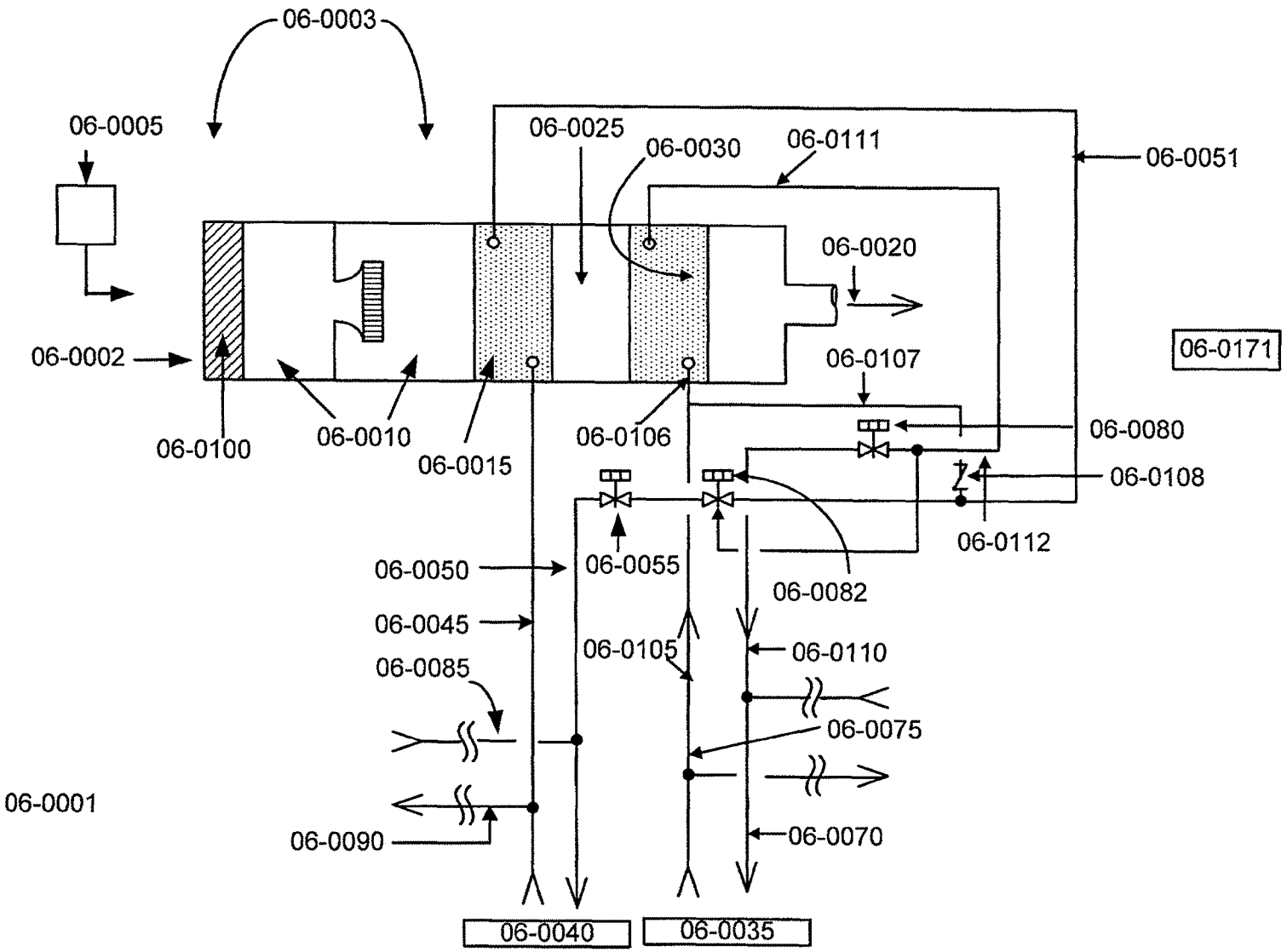
FIG. 6 is a schematic illustration of a cooling, dehumidification and re-heat system in accordance with an alternative implementation.

The system shown in FIG. 6 functions substantially as the system shown in FIG. 5, except that the cooling recovery system re-heat coil is connected to an auxiliary heating source to provide heating to an area being served when the need for heating exceeds that which is otherwise available from the fluid leaving the cooling coil.

A cooling, dehumidification and re-heat system 06-0001 includes one or more AHUs 06-0003, valves 06-0055, 06-0080, 06-0082 and the like. Fluid is cooled in a chiller system 06-0040 and conveyed through a chilled fluid supply piping 06-0045, 06-0090 towards one or more AHUs 06-0003, and returned through the chilled fluid return piping 06-0050, 06-0085 towards one or more chiller systems 06-0040. The cooled fluid is conveyed through the chilled fluid piping via one or more pumping units contained in the chiller systems 06-0040. Fluid is heated in a heating plant 06-0035 and conveyed through a heated fluid supply piping 06-0075, 06-0105, 06-0106 towards one or more heating, reheat or cooling recovery coils 06-0030, and returned through the heated fluid return piping 06-0070, 06-0110, 06-0111 towards one or more heating plant 06-0035. The heated fluid is conveyed through the heated fluid piping via one or more pumping units contained in the heating plant 06-0035.

The flow of chilled fluid to an AHU 06-0003 is controlled by selectively modulating a flow control valve 06-0055. The heating source fluid is controlled by selectively modulating flow control valves, 06-0080, 06-0082. The chilled fluid flow control valves 06-0055 are positioned downstream of respective AHUs 06-0003. The heating source fluid flow control valves 06-0080, 06-0082 are positioned downstream of respective heating coils (cooling recovery coils) 06-0030. Alternatively, however, the valves 06-0055, 06-0080, 06-0082 may be situated upstream of an AHU 06-0003 or upstream of the heating coils (cooling recovery coils) 06-0030 respectively.

Chilled fluid is used to condition air or to remove heat from one or more other sources. For example, chilled water can be distributed through cooling coils 06-0015 or other heat exchange units of an AHU 06-0003. Fans 06-0060 or blowers can receive unconditioned or partially conditioned air from an inlet source consisting of return air 06-0002 and fresh air 06-0005 mixed in varying proportions to create a mixed air stream 06-0010, and deliver the mixed air stream 06-0010 through one or more cooling coils 06-0015. The mixed air stream 06-0010 can either be passed through a filtration system 06-0100 or it can be unfiltered.

As air moves past the cooling coils 06-0015, chilled fluid therein removes heat from the unconditioned or partially conditioned air. When mixed air 06-0010, or conditioned space conditions 06-0171 require it, the conditioned air 06-0025 leaving the cooling coils 06-0015 is cooled to where water is removed from the air and the relative humidity in the conditioned spaces is maintained low enough to reduce the potential for biological growth. Reducing the temperature of the conditioned air 06-0025 will condense moisture from the air, drying it out. Thus, dry, cold conditioned air 06-0025 is delivered to individual offices, rooms or other locations within a facility's interior 06-0171 through a discharge duct 06-0020, or other conveyance system.

The dry, cold conditioned air 06-0025 may be too cold to meet comfort needs or process cooling loads for many of the spaces that require cooling and dehumidification, so the conditioned air 06-0025 is passed through a cooling recovery coil system 06-0030. Warm fluid from the chilled water return piping 06-0051 leaving the cooling coil system 06-0015 is used to add heat to the air to reduce the need for heat from other heating sources, or to meet the need for re-heat in it's entirety. If the leaving air temperature is not raised adequately to meet the needs of the area or process load, warm or hot fluid is used to condition air or to add heat to the air from one or more heating sources.

To recapture the cooling from the cooling coil using the cooling recovery coil, a higher temperature heating source can be introduced. For example, heated water can be distributed through heating coils (cooling recovery coils) 06-0030 or other heat exchange units of an AHU 06-0003.

The AHU 06-0003 includes a control system that controls the control valves 06-0080, 06-0082, which in turn which controls the source, volume or pressure of the heated source fluid that is passed through the heating (cooling recovery) coil 06-0030. Heated fluid is generated in a heating plant or plants 06-0035 and distributed to the AHU's 06-0003 through heating fluid supply piping 06-0075, 06-0105, 06-0106 and heating fluid return piping, 06-0070, 06-0110, 06-0111. The supply air temperature that leaves the heating coil 06-0030, and enters the spaces to be conditioned either directly or through a distribution system 06-0170, is continuously varied to maintain the needs of the occupant or process cooling loads 06-0171 by selectively modulating a flow control valve 06-0080 to add heat to the cold dry dehumidified air.

As a result of the heat exchange occurring at the cooling coils in a cooling recovery coil system 06-0015, the temperature of the fluid passing therethrough increases to approximately 65° F. to 75° F. or higher during the summer months. This heated or spent chilled fluid is collected in a separate spent fluid piping 06-0050, 06-0051, 06-0085 and delivered to the inlet of the chiller system 06-0040. Or, if there is a need for re-heating of some or all of the air that has been cooled and dehumidified, some or all of the heated or spent chilled fluid that has been collected in the separate spent fluid piping 06-0051 is forced into the cooling recovery coil chilled water piping 06-0106, 06-0107 by operating the control valves 06-0080, 06-0082 and forcing the warm chilled water return into the cooling recovery coil heating water supply lines 06-0106, 06-0107 for delivery to the cooling recovery coils as the heating source for the cooling recovery coils.

Figure 7:
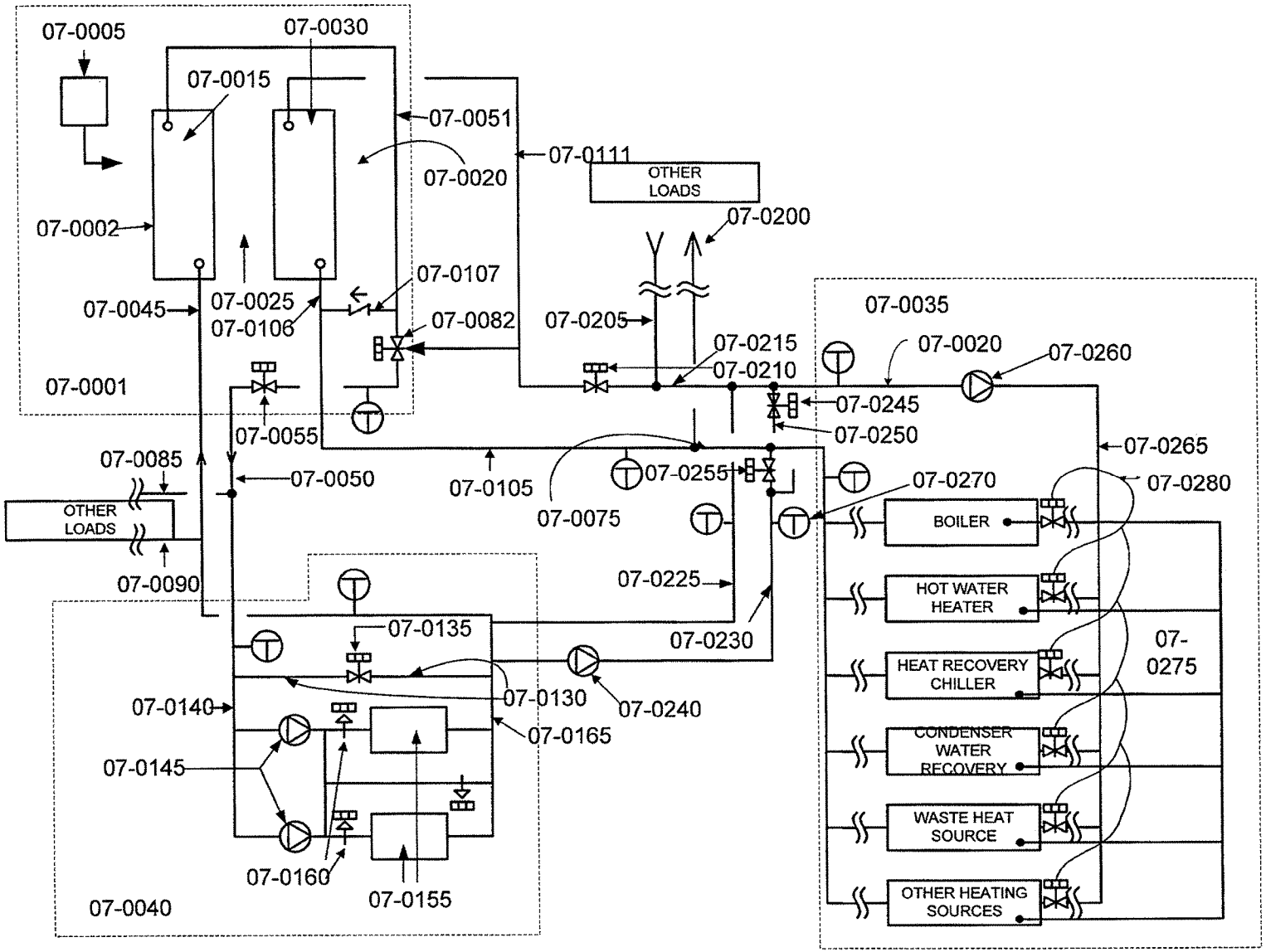
FIG. 7 is a schematic illustration of a cooling recovery coil system in accordance with an implementation.

FIG. 7 depicts an implementation in which the cooling coil system and the cooling recovery coil system can both be used as cooling coils to meet peak day cooling loads, while chiller plant efficiency is improved by using warmer chilled water temperatures due to the increased heat transfer surface area. Additionally, the cooling coil system and cooling recovery coil system can both be used as heating coils to meet peak heating loads while improving hot water plant efficiency by allowing the use of cooler heating water temperatures due to the increased heat transfer surface area. The cooling recovery system re-heat coil is connected to an auxiliary heating source to provide heating to the area being served when the need for heating exceeds that which is otherwise available from the fluid leaving the cooling coil.

As shown in FIG. 7 a cooling, dehumidification and re-heat system 07-0001 includes one or more heat transfer systems 07-0015, 07-0030, valves 07-0055, 07-0082 and the like. Fluid is cooled in a chiller system 07-0040 and conveyed through a chilled fluid supply piping 07-0045, 07-0090 towards the cooling, dehumidification and re-heat system 07-0001 and returned through the chilled fluid return piping 07-0050, 07-0085 towards one or more chiller systems 07-0040. The cooled fluid is conveyed through the chilled fluid piping via one or more pumping units contained in the chiller systems 07-0040. Fluid is heated in a heating plant 07-0035 and conveyed through a heated fluid supply piping 07-0075, 07-0105, 07-0106, 07-0200 towards one or more heating, reheat or cooling recovery coils 07-0030, and returned through the heated fluid return piping 07-0070, 07-0111, 07-0205 towards one or more heating plants 07-0035. The heated fluid is conveyed through the heated fluid piping via one or more pumping units contained in the heating plants 07-0035.

The flow of chilled fluid to cooling coils 07-0015, for heat transfer, is controlled by selectively modulating a flow control valve 07-0055. The heating source fluid is controlled by selectively modulating flow control valve, 07-0082. The chilled fluid flow control valves 07-0055 are positioned downstream of respective cooling coils 07-0015. The heating source fluid flow control valves 07-0082 are positioned downstream of respective heating coils (cooling recovery coils) 07-0030. Alternatively, however, the valves 07-0055, 07-0082 may be situated upstream of cooling coils 07-0015 or upstream of the heating coils (cooling recovery coils) 07-0030 respectively.

Chilled fluid is used to condition air or to remove heat from one or more other sources. For example, chilled water can be distributed through cooling coils 07-0015 or other heat exchange units of an AHU. Fans or blowers can receive unconditioned or partially conditioned air from an inlet source consisting of return air 07-0002 and fresh air 07-0005 mixed in varying proportions to create a mixed air stream and deliver the mixed air stream through one or more cooling coils 07-0015.

As air moves past the cooling coils 07-0015 in cooling recovery coil system, chilled fluid therein removes heat from the unconditioned or partially conditioned air. When mixed air or conditioned space conditions require it, the conditioned air 07-0025 leaving the cooling coils 07-0015 is cooled to where water is removed from the air and the relative humidity in the conditioned spaces is maintained low enough to reduce the potential for biological growth. Reducing the temperature of the conditioned air 07-0025 will condense moisture from the air, drying it out. Thus, dry, cold conditioned air 07-0025 is delivered to individual offices, rooms or other locations within a facility's interior through a discharge duct or other conveyance system.

The dry, cold conditioned air 07-0025 will typically be too cold to meet comfort needs or process cooling loads for many of the spaces that require cooling and dehumidification, so the conditioned air 07-0025 is passed through a cooling recovery coil system 07-0030. Warm fluid that is being sourced from the chilled water return piping 07-0051 that leaves the cooling coils 07-0015 is used to add heat to the air to reduce the need for heat from other heating sources, or to meet the need for re-heat in its entirety. If the leaving air temperature is not raised adequately to meet the needs of the area or process load, warm or hot fluid is used to condition air or to add heat to the air from one or more heating sources.

To augment the heating capacity available from the warm water leaving the cooling coils 07-0015, a higher temperature heating source is introduced. For example, heated fluid can be distributed through heating coils (cooling recovery coils) 07-0030 or other heat exchange units of an AHU. The AHU includes a control system that controls the control valves 07-0082, which in turn control the source, volume or pressure of the heated source fluid that is passed through the cooling recovery coil 07-0030.

Heated fluid is generated in a heating plant or plants 07-0035 and distributed to the AHU's through heating fluid supply piping 07-0075, 07-0105, 07-0106, 07-0210 and heating fluid return piping, 07-0070, 07-0111, 07-0205. The supply air temperature that leaves the heating coil (cooling recovery coil) 07-0030 and enters the spaces to be conditioned, either directly or through a distribution system is continuously varied to maintain the needs of the occupant or process cooling loads by selectively modulating a flow control valve 07-0082 to add heat to the cold dry dehumidified air.

As a result of the heat exchange occurring at the cooling coils 07-0015, the temperature of the fluid passing therethrough increases to approximately 65° F. to 75° F. or higher during the summer months when dehumidification loads are typically present. This heated or spent chilled fluid is collected in a separate spent fluid piping 07-0050, 07-0051, 07-0085 and delivered to the inlet of the chiller system 07-0040. Or, if there is a need for re-heating some or all of the air that has been cooled and dehumidified, some or all of the heated or spent chilled fluid that has been collected in the separate spent fluid piping 07-0051 is forced into the cooling recovery coils 07-0106, 07-0107 by operating the control valves 07-0082, and forcing the warm chilled water return into the cooling recovery coils 07-0106, 07-0107 for delivery as the heating source.

The main components within the chiller plant systems 07-0040 are as follows: 07-0140 is the chilled fluid return piping inside the chiller plant systems, and is the piping in which all of the various fluid streams mix and become one common fluid stream. The fluid is returned from the cooling loads imposed by the AHU's or process cooling loads through the chilled fluid piping 07-0085, 07-0050, mixed with the fluid returning from the cooling recovery coil systems, and the fluid from the bypass piping 07-0130. The mixed fluid is then drawn into the chilled fluid pumping systems 07-0145.

The chilled fluid pumping systems is provided in a draw-through or push-through configuration with the chillers 07-0155. The warm mixed fluid is then passed through the chiller systems 07-0155 where the fluid temperature is reduced. The chiller isolation valves 07-0160 are controlled to allow flow through the chillers that are operational. The chilled fluid then enters a common discharge piping 07-0165, where it is either delivered to the cooling loads through the supply piping 07-0090, 07-0045, or is returned to the chilled fluid return piping by passing through the chilled fluid bypass piping 07-0130 and bypass piping control valve 07-0135. While FIG. 7 illustrates one piping arrangement, and other piping configurations can be used.

The main components within the heating plant systems 07-0035 are as follows: 07-0265 is the heated fluid return piping inside the heating plant systems, and is the piping where all of the various fluid streams mix and become one common fluid stream. The fluid is returned from the heating loads imposed by the AHU's or process loads through heated fluid piping 07-0020, 07-0215, 07-0205 mixed with the fluid returning from the cooling recovery coil systems, 07-0111, the fluid from heating/cooling crossover piping, 07-0225, 07-0230 and the fluid from the bypass piping 07-0250. The mixed fluid is then drawn into the heated fluid pumping systems 07-0260.

The heated fluid pumping systems are provided in a draw-through or push-through configuration with heaters 07-0275. The warm mixed fluid is then passed through the heater systems 07-0275 where the fluid temperature is increased. The heater isolation valves 07-0280 are controlled to allow flow through operational heaters. The heated fluid then enters a common discharge piping 07-0270 where it is either delivered to the heating loads through the supply piping 07-0075, 07-0105, or is returned to the heated fluid return piping by passing through the heated fluid bypass piping 07-0250 and bypass piping control valve 07-0245, 07-0255. FIG. 7 shows the heaters piped in one arrangement, although different arrangements are possible.

Figure 8:
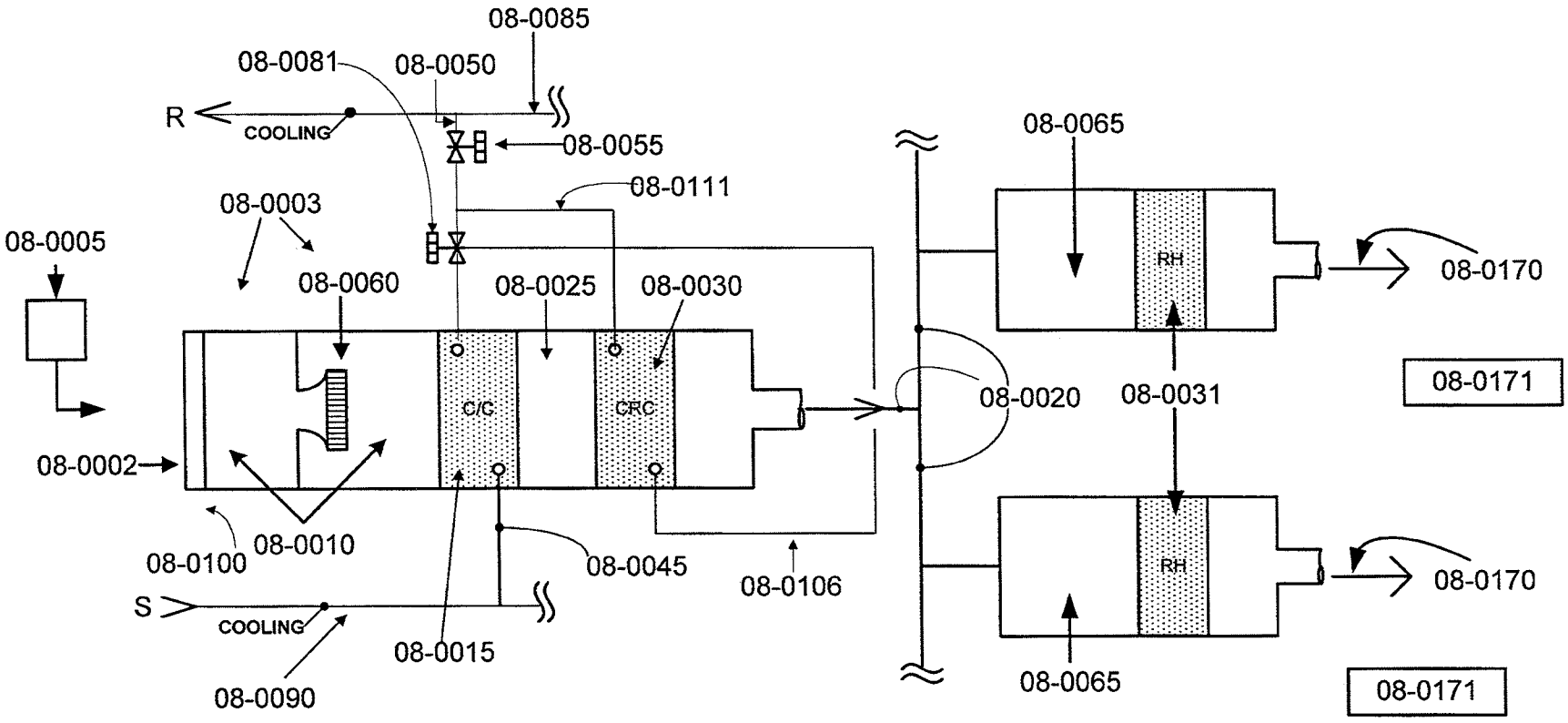
FIG. 8 is a schematic illustration of a cooling recovery coil system with downstream heating or reheating system diverting valve.

The system shown in FIG. 8 functions substantially as the system shown in FIG. 6, except that the cooling recovery system cooling recovery coil is directly connected to the cooling coil via pipes and valves 08-111, 08-106, 08-0081, 08-0055, 08-0050, and there is an auxiliary reheat coil system 08-0065, 08-0031 that is connected to a heating source to provide heating to an area being served when the need for heating exceeds that which is otherwise available from the fluid leaving the cooling coil and cooling recovery coil systems.

In some implementations, a cooling, dehumidification and re-heat system 08-0001 includes one or more AHUs 08-0003, valves 08-0055, 08-0081, and the like. Fluid is cooled in a chiller system not shown in this figure and conveyed through a chilled fluid supply piping 08-0045, towards one or more AHUs 08-0003, and returned through the chilled fluid return piping 08-0050, 08-0085 towards one or more chiller systems. The cooled fluid is conveyed through the chilled fluid piping via one or more pumping units contained in the chiller systems. Fluid is heated in a heating plant and conveyed through a heated fluid supply piping towards one or more heating, or reheat coils 08-0031, and returned through the heated fluid return piping towards one or more heating plants. The heated fluid is conveyed through the heated fluid piping via one or more pumping units contained in the heating plant.

The flow of chilled fluid to an AHU 08-0003 is controlled by selectively modulating a flow control valve 08-0055. The cooling recovery coil source fluid is controlled by selectively modulating flow control valves, 08-0081, 08-0055. The heating source fluid is controlled by selectively modulating flow control valves, not shown in this figure. The chilled fluid flow control valves 08-0055, 08-0081 are positioned downstream of respective AHUs 08-0003. Alternatively, however, the valves 08-0055, 08-0081 may be situated upstream of an AHU 08-0003 or upstream of the cooling recovery coils 08-0030 respectively.

Chilled fluid is used to condition air or to remove heat from one or more other sources. For example, chilled water can be distributed through cooling coils 08-0015 or other heat exchange units of an AHU 08-0003. Fans 08-0060 or blowers can receive unconditioned or partially conditioned air from an inlet source consisting of return air 08-0002 and fresh air 08-0005 mixed in varying proportions to create a mixed air stream 08-0010, and deliver the mixed air stream 08-0010 through one or more cooling coils 08-0015. The mixed air stream 08-0010 can either be passed through a filtration system 08-0100 or it can be unfiltered.

As air moves past the cooling coils 08-0015, chilled fluid therein removes heat from the unconditioned or partially conditioned air. When mixed air 08-0010, or conditioned space conditions 08-0171 require it, the conditioned air 08-0025 leaving the cooling coils 08-0015 is cooled to where water is removed from the air and the relative humidity in the conditioned spaces is maintained low enough to reduce the potential for biological growth. Reducing the temperature of the conditioned air 08-0025 will condense moisture from the air, drying it out. Thus, dry, cold conditioned air 08-0025 is delivered to individual offices, rooms or other locations within a facility's interior 08-0171 through a discharge duct 08-0020, or other conveyance system.

The dry, cold conditioned air 08-0025 may be too cold to meet comfort needs or process cooling loads for many of the spaces that require cooling and dehumidification, so the conditioned air 08-0025 is passed through a cooling recovery coil system 08-0030. Warm fluid from the chilled water return piping 08-0051 leaving the cooling coil system 08-0015 is used to add heat to the air to reduce the need for heat from other heating sources, or to meet the need for re-heat in it's entirety; If the leaving air temperature is not raised adequately to meet the needs of the area or process load, warm or hot fluid is used to condition air or to add heat to the air from one or more heating sources by sending this warm fluid through a reheat coil system 08-0031.

To recapture the cooling from the cooling coil using the cooling recovery coil, a higher temperature heating source is introduced and used to add heat to the air entering the reheat coil system 08-0031. For example, heated water can be distributed through heating coils 08-0031 or other heat exchange units of a temperature control zone, 08-0065. The temperature control zone, 08-0065 includes a control system that controls the control valves not shown in this figure, which in turn which controls the source, volume or pressure of the heated source fluid that is passed through the heating coil 08-0031. Heated fluid is generated in a heating plant or plants and distributed to the temperature control zones, 08-0065 through heating fluid supply and return piping. The supply air temperature that leaves the heating coil 08-0031, and enters the spaces to be conditioned either directly or through a distribution system 08-0170, is continuously varied to maintain the needs of the occupant or process cooling loads 08-0171 by selectively modulating a flow control valve to add heat to the cold dry dehumidified air.

As a result of the heat exchange occurring at the cooling coils in a cooling recovery coil system 08-0015, the temperature of the fluid passing therethrough increases to approximately 65° F. to 75° F. or higher during the summer months. This heated or spent chilled fluid is collected in a separate spent fluid piping 08-0050, and delivered to the inlet of the chiller system. Or, if there is a need for re-heating of some or all of the air that has been cooled and dehumidified, some or all of the heated or spent chilled fluid that has been collected in the separate spent fluid piping is forced into the cooling recovery coil chilled water piping 08-0106, by operating the control valves 08-0081 and forcing the warm chilled water return into the cooling recovery coil heating water supply lines 08-0106, for delivery to the cooling recovery coils as the heating source for the cooling recovery coils.

Heated fluid is generated in a heating plant or plants and distributed to the temperature control zones 08-0065 through heating fluid supply and return piping, not shown in FIG. 8. The supply air temperature that leaves the heating coil 08-0031 enters the spaces to be conditioned, either directly or through a distribution system 08-0170. The supply air temperature is continuously varied to maintain the needs of the occupant or process cooling loads 08-0171 by selectively modulating a flow control valve to add additional heat to the cold dry dehumidified air.

The dry, cold conditioned air 03-0025 may be too cold to meet comfort needs or process cooling loads for many of the spaces that require cooling and dehumidification, so the conditioned air 08-0025 is passed through the cooling recovery coil 08-0030 to add heat to the air and warm it up. The air is then delivered to temperature control boxes 08-0065 that contain a heating coil 08-0031. If the space conditions or process cooling loads 08-0171 require air that is warmer than that which is provided after leaving the cooling recovery coil 08-0030, the reheat coil 08-0031 is activated. Warm or hot fluid is used to condition air or to add heat to the air from one or more heating sources. For example, heated water can be distributed through heating coils 08-0031 or other heat exchange units of a temperature control box 08-0065. The temperature control box 08-0065 includes a controller that controls a control valve, which in turn controls the volume or pressure of the heated source fluid that is passed through the heating coil 08-0031.

Heated fluid is generated in a heating plant or plants not shown in this figure and distributed to the temperature control zones 08-0065 through heating fluid supply and return piping (not shown). The supply air temperature that leaves the heating coil 08-0031 enters the spaces to be conditioned, either directly or through a distribution system 08-0170. The supply air temperature is continuously varied to maintain the needs of the occupant or process cooling loads 08-0171 by selectively modulating a flow control valve not shown in this figure to add heat to the cold dry dehumidified air.

Figure 9:
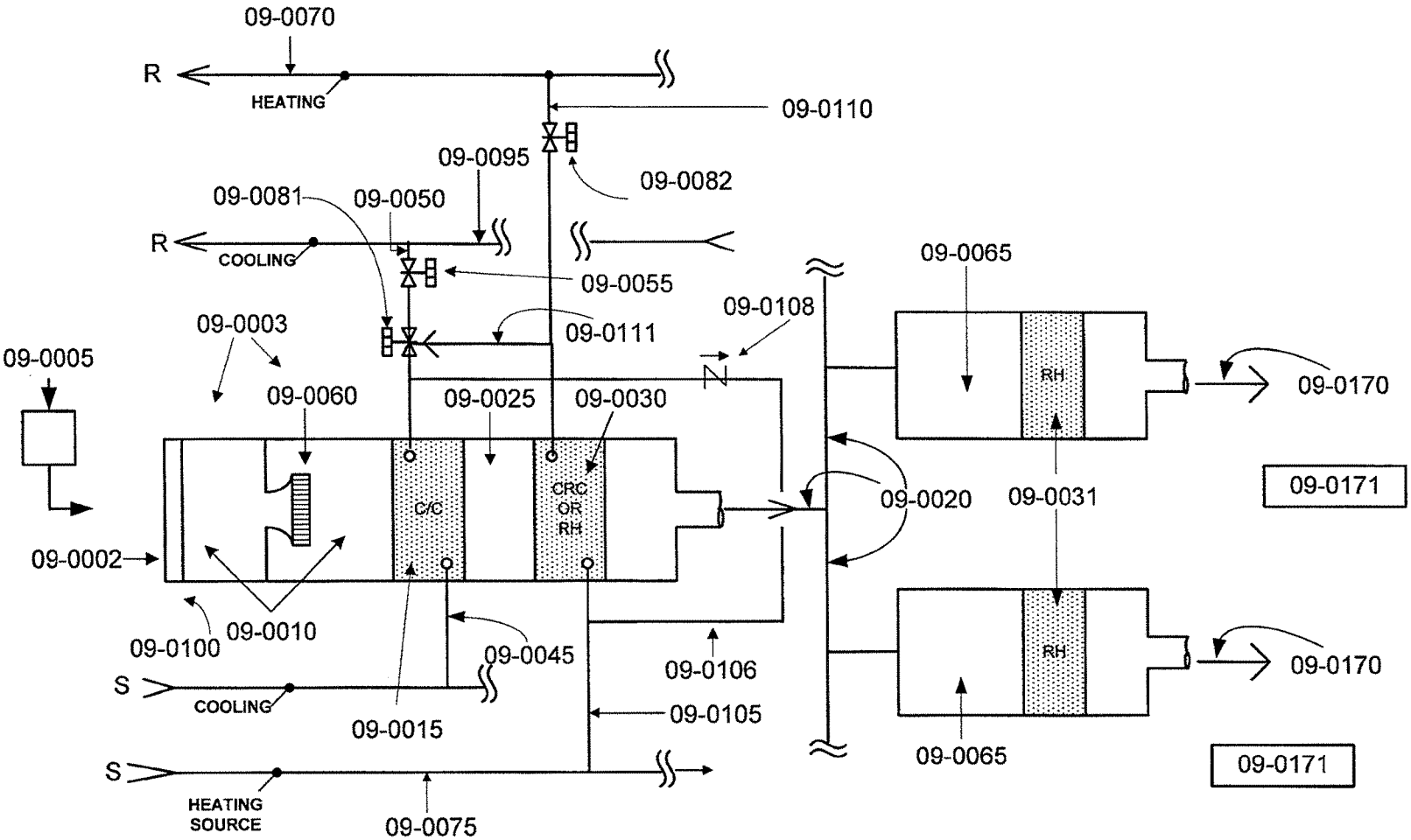
FIG. 9 is a schematic illustration of a cooling recovery coil system in accordance with another implementation.

The system shown in FIG. 9 functions substantially as the system shown in FIG. 8, except that the cooling recovery system cooling recovery re-heat coil are provided with heating water sourced either directly from the cooling coil, or from any auxiliary heating source, and there is an auxiliary reheat coil 09-0065 that is connected to a heating source to provide heating to an area being served when the need for heating exceeds that which is otherwise available from the fluid leaving the cooling coil.

Cooling, dehumidification and re-heat system 09-0001 includes one or more AHUs 09-0003, valves 09-0055, 09-0081, and the like. Fluid is cooled in a chiller system and conveyed through a chilled fluid supply piping 09-0045 towards one or more AHUs 09-0003, and returned through the chilled fluid return piping 09-0050, 09-0085 towards one or more chiller systems. The cooled fluid is conveyed through the chilled fluid piping via one or more pumping units contained in the chiller systems. Fluid is heated in a heating plant and conveyed through a heated fluid supply piping 09-0075, 09-0105 towards one or more heating, reheat or cooling recovery coils 09-0030, 09-0031 and returned through the heated fluid return piping 09-0070, 09-0110, towards one or more heating plants. The heated fluid is conveyed through the heated fluid piping via one or more pumping units contained in the heating plant.

The flow of chilled fluid to an AHU 09-0003 is controlled by selectively modulating a flow control valve 09-0055. The cooling recovery coil heating source fluid is controlled by selectively modulating flow control valve 09-0081. The chilled fluid flow control valves 09-0055 are positioned downstream of respective AHUs 09-0003. The cooling recovery coil heating source fluid flow control valve, 09-0081 is positioned upstream of respective cooling recovery coils 09-0030. Alternatively, however, the valves 09-0055, 09-0081, may be situated upstream of an AHU 09-0003 or downstream of the cooling recovery coils 09-0030 respectively.

Chilled fluid is used to condition air or to remove heat from one or more other sources. For example, chilled water is distributed through cooling coils 09-0015 or other heat exchange units of an AHU 09-0003. Fans 09-0060 or blowers can receive unconditioned or partially conditioned air from an inlet source consisting of a mixture of return air 09-0002 and fresh air 09-0005 to create a stream of mixed air 09-0010 for delivery to one or more cooling coils 09-0015. The mixed air 09-0010 can either be passed through a filtration system 09-0100 or it can be unfiltered.

As air moves past the cooling coils 09-0015, chilled fluid therein removes heat from the unconditioned or partially conditioned air. When mixed air 09-0010, or conditioned space conditions 09-0171 require it, the conditioned air 09-0025 leaving the cooling coils 09-0015 is cooled to where water is removed from the air and the relative humidity in the conditioned spaces is maintained low enough to reduce the potential for biological growth. Reducing the temperature of the conditioned air 09-0025 will condense moisture from the air, drying it out. Thus, dry, cold conditioned air 09-0025 is delivered to individual offices, rooms or other locations within a facility's interior 09-0171 through a discharge duct 09-0020, or other conveyance system.

The dry, cold conditioned air 09-0025 may be too cold to meet comfort needs or process cooling loads for many of the spaces that require cooling and dehumidification, so the conditioned air 09-0025 is passed through a cooling recovery coil system 09-0030. Warm fluid from the chilled water return piping 09-0111 leaving the cooling coil system 09-0015 is used to add heat to the air to reduce the need for heat from other heating sources, or to meet the need for re-heat in it's entirety. If the leaving air temperature is not raised adequately to meet the needs of the area or process load, warm or hot fluid is used to condition air or to add heat to the air from one or more heating sources. To recapture the cooling from the cooling coil using the cooling recovery coil, a higher temperature heating source is introduced. For example, heated water can be distributed through heating coils (cooling recovery coils) 09-0030 or other heat exchange units of an AHU 09-0003.

The AHU 09-0003 includes a control system that controls the control valves 09-0081, 09-0082, which in turn which controls the source, volume or pressure of the heated source fluid that is passed through the heating cooling recovery coil 09-0030. Heated fluid is generated in a heating plant or plants and distributed to the AHU's 09-0003 through heating fluid supply piping 09-0075, 09-0105, and heating fluid return piping, 09-0070, 09-0110. If further heating of the air is required, a heating coil 09-0031 located in a temperature control box 09-0065 is operated as required to increase the temperature of the air as required. The supply air temperature that leaves the heating coil 09-0031, and enters the spaces to be conditioned either directly or through a distribution system 09-0170, is continuously varied to maintain the needs of the occupant or process cooling loads 09-0171 by selectively modulating a flow control valve to add heat to the dehumidified air.

As a result of the heat exchange occurring at the cooling coils in a cooling recovery coil system 09-0015, the temperature of the fluid passing therethrough increases to approximately 65° F. to 75° F. or higher during the summer months. This heated or spent chilled fluid is collected in a separate spent fluid piping 09-0050, 09-0085 and delivered to the inlet of the chiller system. Or, if there is a need for re-heating of some or all of the air that has been cooled and dehumidified, some or all of the heated or spent chilled fluid that has been collected in the separate spent fluid piping is forced into the cooling recovery coil chilled water piping 09-0106, and check valve system 09-0108 by operating the control valves 09-0081 and forcing the warm chilled water return into the cooling recovery coil heating water supply lines 09-0106, for delivery to the cooling recovery coils as the heating source for the cooling recovery coils.

Heated fluid is generated in a heating plant or plants and distributed to the temperature control zones 09-0065 through heating fluid supply and return piping, not shown in this figure. The supply air temperature that leaves the heating coil 09-0031 enters the spaces to be conditioned, either directly or through a distribution system 09-0170. The supply air temperature is continuously varied to maintain the needs of the occupant or process cooling loads 09-0171 by selectively modulating a flow control valve not shown in this figure to add heat to the air.

The dry, cold conditioned air 08-0025 may be too cold to meet comfort needs or process cooling loads for many of the spaces that require cooling and dehumidification, so the conditioned air 08-0025 is passed through the cooling recovery coil 09-0030 to add heat to the air and warm it up. The air is then delivered to temperature control boxes 09-0065 that contain a heating coil 09-0031. If the space conditions or process cooling loads 09-0171 require air that is warmer than that which is provided after leaving the cooling recovery coil 09-0030, the reheat coil 09-0031 is activated. Warm or hot fluid is used to condition air or to add heat to the air from one or more heating sources. For example, heated water can be distributed through heating coils 09-0031 or other heat exchange units of a temperature control box 09-0065. The temperature control box 09-0065 includes a controller that controls the control valve not shown in this figure, which in turn controls the volume or pressure of the heated source fluid that is passed through the heating coil 09-0031.

Heated fluid is generated in a heating plant or plants not shown in this figure and distributed to the temperature control zones 09-0065 through heating fluid supply and return piping not shown in this figure. The supply air temperature that leaves the heating coil 09-0031 enters the spaces to be conditioned, either directly or through a distribution system 09-0170. The supply air temperature is continuously varied to maintain the needs of the occupant or process cooling loads 09-0171 by selectively modulating a flow control valve not shown in this figure to add heat to the cold dry dehumidified air.

Figure 10:
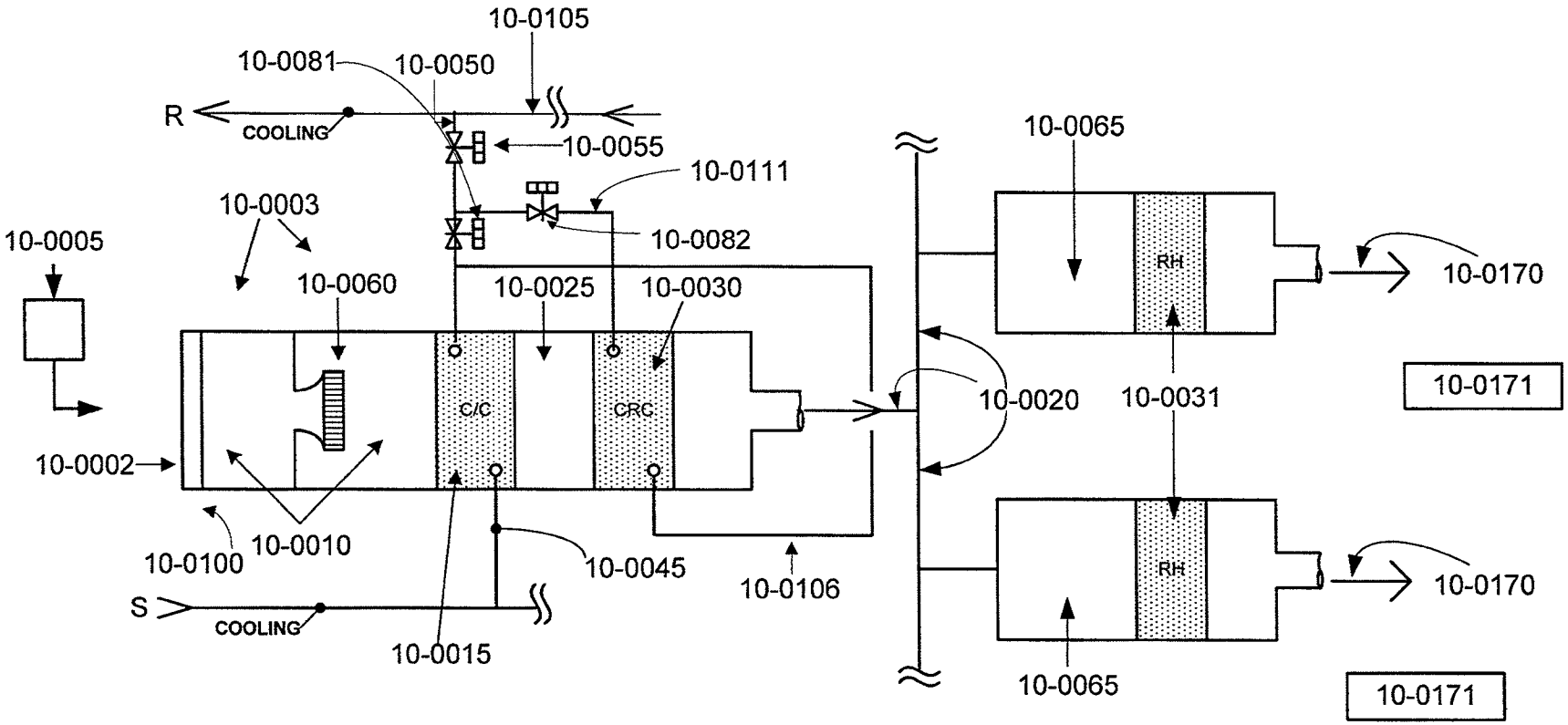
FIG. 10 is a schematic illustration of a cooling recovery coil system with an alternative valve configuration.

The system shown in FIG. 10 functions substantially as the system shown in FIG. 8, although a different piping and valve system arrangement is used to convey the warm spent chilled water return fluid to the cooling recovery coil inlet. Cooling, dehumidification and re-heat system 10-0001 includes one or more AHUs 10-0003, valves 10-0055, 10-0081, 10-0082, and the like. Fluid is cooled in a chiller system not shown in this figure and conveyed through a chilled fluid supply piping 10-0045, towards one or more AHUs 10-0003, and returned through chilled fluid return piping 10-0050, 10-0085 towards one or more chiller systems. The cooled fluid is conveyed through the chilled fluid piping via one or more pumping units contained in the chiller systems. Fluid is heated in a heating plant and conveyed through a heated fluid supply piping towards one or more heating, or reheat coils 10-0031, and returned through the heated fluid return piping towards one or more heating plants. The heated fluid is conveyed through the heated fluid piping via one or more pumping units contained in the heating plant.

The flow of chilled fluid to an AHU 10-0003 is controlled by selectively modulating a flow control valve 10-0055. The cooling recovery coil source fluid is controlled by selectively modulating flow control valves 10-0081, 10-0082, and 10-0055. The heating source fluid is controlled by selectively modulating flow control valves, not shown in this figure. The chilled fluid flow control valves 10-0055, 10-0081, 10-0082 are positioned downstream of respective AHUs 10-0003. Alternatively, however, the valves 10-0055, 10-0081, 10-0082 may be situated upstream of an AHU 10-0003 or upstream of the cooling recovery coils 10-0030 respectively.

Chilled fluid is used to condition air or to remove heat from one or more other sources. For example, chilled water can be distributed through cooling coils 10-0015 or other heat exchange units of an AHU 10-0003. Fans 10-0060 or blowers can receive unconditioned or partially conditioned air from an inlet source consisting of return air 10-0002 and fresh air 10-0005 mixed in varying proportions to create a mixed air stream 10-0010, and deliver the mixed air stream 10-0010 through one or more cooling coils 10-0015. The mixed air stream 10-0010 can either be passed through a filtration system 10-0100 or it can be unfiltered.

As air moves past the cooling coils 10-0015, chilled fluid therein removes heat from the unconditioned or partially conditioned air. When mixed air 10-0010, or conditioned space conditions 10-0171 require it, the conditioned air 10-0025 leaving the cooling coils 10-0015 is cooled to where water is removed from the air and the relative humidity in the conditioned spaces is maintained low enough to reduce the potential for biological growth. Reducing the temperature of the conditioned air 10-0025 will condense moisture from the air, drying it out. Thus, dry, cold conditioned air 10-0025 is delivered to individual offices, rooms or other locations within a facility's interior 10-0171 through a discharge duct 10-0020, or other conveyance system.

The dry, cold conditioned air 10-0025 may be too cold to meet comfort needs or process cooling loads for many of the spaces that require cooling and dehumidification, so the conditioned air 10-0025 is passed through a cooling recovery coil system 10-0030. Warm fluid from the chilled water return piping 10-0051 leaving the cooling coil system 10-0015 is used to add heat to the air to reduce the need for heat from other heating sources, or to meet the need for re-heat in it's entirety. If the leaving air temperature is not raised adequately to meet the needs of the area or process load, warm or hot fluid is used to condition air or to add heat to the air from one or more heating sources by sending this warm fluid through a reheat coil system 10-0031.

To recapture the cooling from the cooling coil using the cooling recovery coil, a higher temperature heating source is introduced and used to add heat to the air entering the reheat coil system via heating coils 10-0031. For example, heated water can be distributed through heating coils 10-0031 or other heat exchange units of a temperature control zone, 10-0065. The temperature control zone, 10-0065 includes a control system that controls the control valves not shown in this figure, which in turn which controls the source, volume or pressure of the heated source fluid that is passed through the heating coil 10-0031. Heated fluid is generated in a heating plant or plants and distributed to the temperature control zones, 10-0065 through heating fluid supply and return piping. The supply air temperature that leaves the heating coil 10-0031, and enters the spaces to be conditioned either directly or through a distribution system 10-0170, is continuously varied to maintain the needs of the occupant or process cooling loads 10-0171 by selectively modulating a flow control valve to add heat to the cold dry dehumidified air.

As a result of the heat exchange occurring at the cooling coils in a cooling recovery coil system 10-0015, the temperature of the fluid passing therethrough increases to approximately 65° F. to 75° F. or higher during the summer months. This heated or spent chilled fluid is collected in a separate spent fluid piping 10-0050, and delivered to the inlet of the chiller system. Or, if there is a need for re-heating of some or all of the air that has been cooled and dehumidified, some or all of the heated or spent chilled fluid that has been collected in the separate spent fluid piping is forced into the cooling recovery coil chilled water piping 10-0106, by operating the control valves 10-0081, 10-0082 and forcing the warm chilled water return into the cooling recovery coil heating water supply lines 10-0106, for delivery to the cooling recovery coils as the heating source for the cooling recovery coils.

Heated fluid is generated in a heating plant or plants and distributed to the temperature control zones 10-0065 through heating fluid supply and return piping, not shown in this figure. The supply air temperature that leaves the heating coil 10-0031 enters the spaces to be conditioned, either directly or through a distribution system 10-0170. The supply air temperature is continuously varied to maintain the needs of the occupant or process cooling loads 10-0171 by selectively modulating a flow control valve not shown in this figure to add additional heat to the cold dry dehumidified air.

The dry, cold conditioned air 10-0025 may be too cold to meet comfort needs or process cooling loads for many of the spaces that require cooling and dehumidification, so the conditioned air 10-0025 is passed through the cooling recovery coil 10-0030 to add heat to the air and warm it up. The air is then delivered to temperature control boxes 10-0065 that contain a heating coil 10-0031. If the space conditions or process cooling loads 10-0171 require air that is warmer than that which is provided after leaving the cooling recovery coil 10-0030, the heating coil 10-0031 is activated. Warm or hot fluid is used to condition air or to add heat to the air from one or more heating sources. For example, heated water is distributed through heating coil 10-0031 or other heat exchange units of a temperature control box 10-0065. The temperature control box 10-0065 includes a controller that controls the control valve not shown in this figure, which in turn controls the volume or pressure of the heated source fluid that is passed through the heating coil 10-0031.

Heated fluid is generated in a heating plant or plants not shown in this figure and distributed to the temperature control zones 10-0065 through heating fluid supply and return piping (not shown). The supply air temperature that leaves the heating coil 10-0031 enters the spaces to be conditioned, either directly or through a distribution system 10-0170. The supply air temperature is continuously varied to maintain the needs of the occupant or process cooling loads 10-0171 by selectively modulating a flow control valve to add heat to the cold dry dehumidified air.

Figure 11:
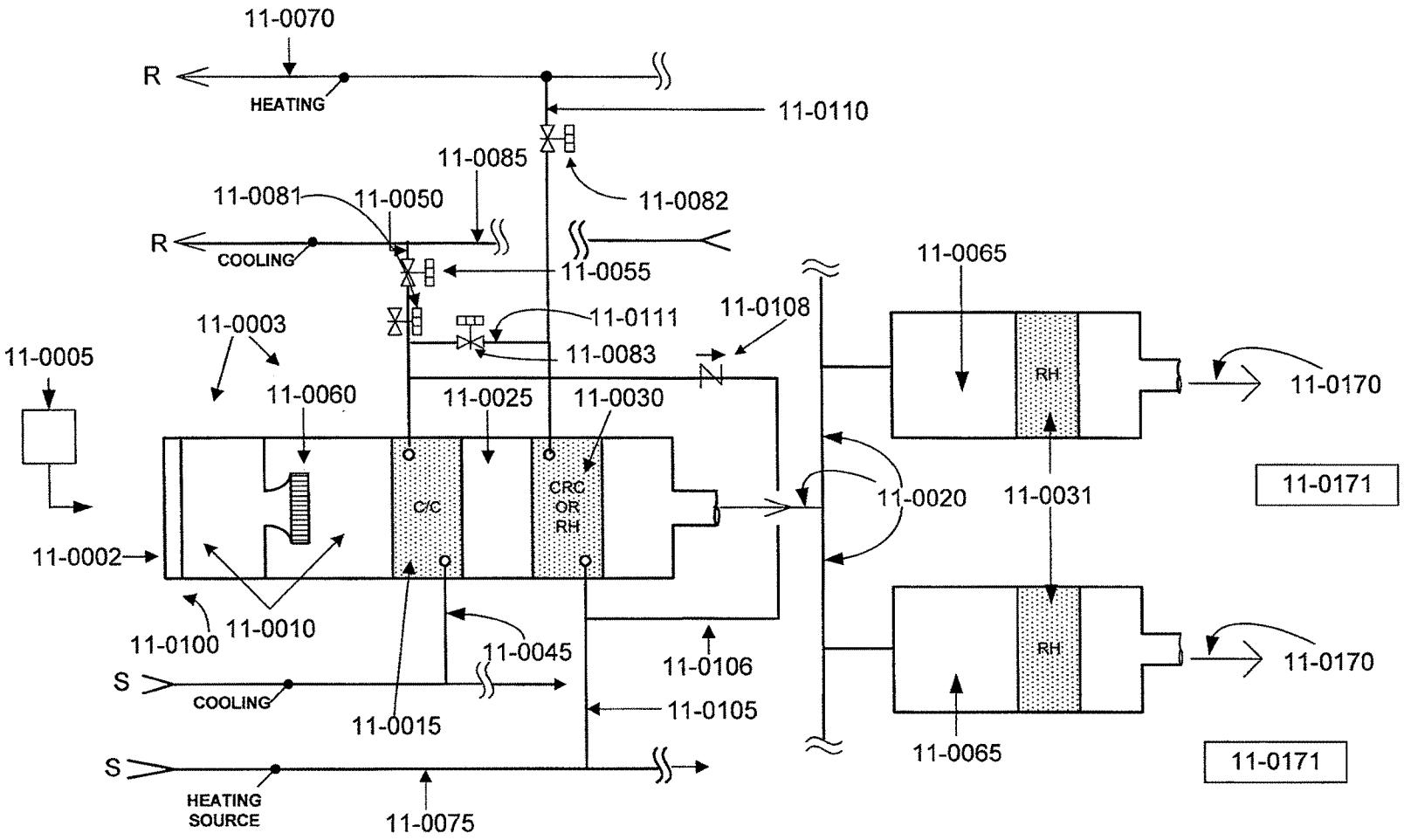
FIG. 11 is a schematic illustration of a cooling recovery coil system with another alternative valve configuration.

The system shown in FIG. 11 functions substantially as the system shown in FIG. 9, although a different piping and valve system arrangement is used to convey the warm spent chilled water return fluid to the cooling recovery coil inlet. Cooling, dehumidification and re-heat system 11-0001 includes one or more AHUs 11-0003, valves 11-0055, 11-0081, and the like. Fluid is cooled in a chiller system and conveyed through a chilled fluid supply piping 11-0045 towards one or more AHUs 11-0003, and returned through the chilled fluid return piping 11-0050, 11-0085 towards one or more chiller systems. The cooled fluid is conveyed through the chilled fluid piping via one or more pumping units contained in the chiller systems. Fluid is heated in a heating plant and conveyed through a heated fluid supply piping 11-0075, 11-0105 towards one or more heating, reheat or cooling recovery coils 11-0030, 11-0031 and returned through the heated fluid return piping 11-0070, 11-0110, towards one or more heating plants. The heated fluid is conveyed through the heated fluid piping via one or more pumping units contained in the heating plant.

The flow of chilled fluid to an AHU 11-0003 is controlled by selectively modulating a flow control valve 11-0055. The cooling recovery coil heating source fluid is controlled by selectively modulating flow control valve 11-0081. The chilled fluid flow control valves 11-0055 are positioned downstream of respective AHUs 11-0003. The cooling recovery coil heating source fluid flow control valve, 11-0081 is positioned upstream of respective cooling recovery coils 11-0030. Alternatively, however, the valves 11-0055, 11-0081, may be situated upstream of an AHU 11-0003 or downstream of the cooling recovery coils 11-0030 respectively.

Chilled fluid is used to condition air or to remove heat from one or more other sources. For example, chilled water can be distributed through cooling coils 11-0015 or other heat exchange units of an AHU 11-0003. Fans 11-0060 or blowers can receive unconditioned or partially conditioned air from an inlet source consisting of return air 11-0002 and fresh air 11-0005 mixed in varying proportions to create a mixed, air stream 11-0010, and deliver the mixed air stream 11-0010 through one or more cooling coils 11-0015. The mixed air stream 11-0010 can either be passed through a filtration system 11-0100 or it can be unfiltered.

As air moves past the cooling coils 11-0015, chilled fluid therein removes heat from the unconditioned or partially conditioned air. When mixed air 11-0010, or conditioned space conditions 11-0171 require it, the conditioned air 11-0025 leaving the cooling coils 11-0015 is cooled to where water is removed from the air and the relative humidity in the conditioned spaces is maintained low enough to reduce the potential for biological growth. Reducing the temperature of the conditioned air 11-0025 condenses moisture from the air, drying it out. Thus, dry, cold conditioned air 11-0025 is delivered to individual offices, rooms or other locations within a facility's interior 11-0171 through a discharge duct 11-0020, or other conveyance system.

The dry, cold conditioned air 11-0025 may be too cold to meet comfort needs or process cooling loads for many of the spaces that require cooling and dehumidification, so the conditioned air 11-0025 is passed through a cooling recovery coil system 11-0030. Warm fluid from the chilled water return piping 11-0111 leaving the cooling coil system 11-0015 is used to add heat to the air to reduce the need for heat from other heating sources, or to meet the need for re-heat in it's entirety. If the leaving air temperature is not raised adequately to meet the needs of the area or process load, warm or hot fluid is used to condition air or to add heat to the air from one or more heating sources.

To recapture the cooling from the cooling coil using the cooling recovery coil, a higher temperature heating source is introduced. For example, heated water can be distributed through heating coils (cooling recovery coils) 11-0030 or other heat exchange units of an AHU 11-0003.

The AHU 11-0003 includes a control system that controls the control valves 11-0081, 11-0082, which in turn which controls the source, volume or pressure of the heated source fluid that is passed through the heating cooling recovery coil 11-0030. Heated fluid is generated in a heating plant or plants and distributed to the AHU's 11-0003 through heating fluid supply piping 11-0075, 11-0105, and heating fluid return piping, 11-0070, 11-0110. If further heating of the air is required, a heating coil 11-0031 located in a temperature control box 11-0065 is operated as required to increase the temperature of the air as required. The supply air temperature that leaves the heating coil 11-0031, and enters the spaces to be conditioned either directly or through a distribution system 11-0170, is continuously varied to maintain the needs of the occupant or process cooling loads 11-0171 by selectively modulating a flow control valve to add heat to the dehumidified air.

As a result of the heat exchange occurring at the cooling coils in a cooling recovery coil system 11-0015, the temperature of the fluid passing therethrough increases to approximately 65° F. to 75° F. or higher during the summer months. This heated or spent chilled fluid is collected in a separate spent fluid piping 11-0050, 11-0085 and delivered to the inlet of the chiller system. Or, if there is a need for re-heating of some or all of the air that has been cooled and dehumidified, some or all of the heated or spent chilled fluid that has been collected in the separate spent fluid piping is forced into the cooling recovery coil chilled water piping 11-0106, and check valve system 11-0108 by operating the control valves 11-0081 and forcing the warm chilled water return into the cooling recovery coil heating water supply lines 11-0106, for delivery to the cooling recovery coils as the heating source for the cooling recovery coils.

Heated fluid is generated in a heating plant or plants and distributed to the temperature control zones 11-0065 through heating fluid supply and return piping, not shown in this figure. The supply air temperature that leaves the heating coil 11-0031 enters the spaces to be conditioned, either directly or through a distribution system 11-0170. The supply air temperature is continuously varied to maintain the needs of the occupant or process cooling loads 11-0171 by selectively modulating a flow control valve not shown in this figure to add heat to the air.

The dry, cold conditioned air 08-0025 may be too cold to meet comfort needs or process cooling loads for many of the spaces that require cooling and dehumidification, so the conditioned air 08-0025 is passed through the cooling recovery coil 11-0030 to add heat to the air and warm it up. The air is then delivered to temperature control boxes 11-0065 that contain a heating coil 11-0031. If the space conditions or process cooling loads 11-0171 require air that is warmer than that which is provided after leaving the cooling recovery coil 11-0030, the heating coil 11-0031 is activated as a reheat coil. Warm or hot fluid is used to condition air or to add heat to the air from one or more heating sources. For example, heated water can be distributed through heating coils 11-0031 or other heat exchange units of a temperature control box 11-0065. The temperature control box 11-0065 includes a controller that controls the control valve not shown in this figure, which in turn controls the volume or pressure of the heated source fluid that is passed through the heating coil 11-0031.

Heated fluid is generated in a heating plant or plants not shown in this figure and distributed to the temperature control zones 11-0065 through heating fluid supply and return piping not shown in this figure. The supply air temperature that leaves the heating coil 11-0031 enters the spaces to be conditioned, either directly or through a distribution system 11-0170. The supply air temperature is continuously varied to maintain the needs of the occupant or process cooling loads 11-0171 by selectively modulating a flow control valve not shown in this figure to add heat to the cold dry dehumidified air.

Figure 12:
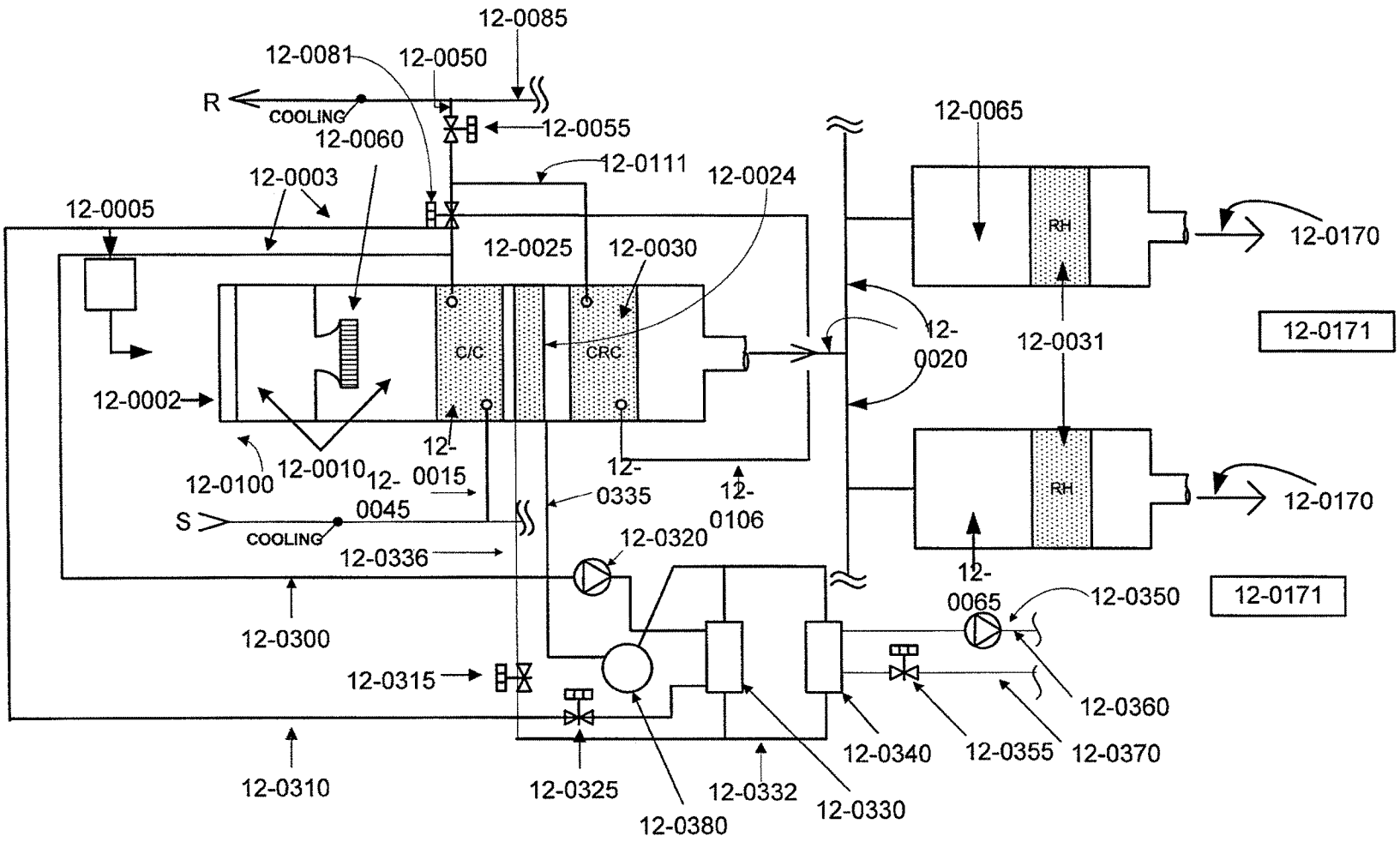
FIG. 12 is a schematic illustration of a cooling recovery coil system in accordance with another implementation.

The system shown in FIG. 12 functions substantially as the system shown in FIG. 8, except that there is an additional cooling coil and heat recovery system applied to the cooling recovery coil system. Cooling, dehumidification and re-heat system 12-0001 includes one or more AHUs 12-0003, valves 12-0055, 12-0081, and the like. Fluid is cooled in a chiller system not shown in this figure and conveyed through a chilled fluid supply piping 12-0045, towards one or more AHUs 12-0003, and returned through the chilled fluid return piping 12-0050, 12-0085 towards one or more chiller systems. The cooled fluid is conveyed through the chilled fluid piping via one or more pumping units contained in the chiller systems. Fluid is heated in a heating plant and conveyed through a heated fluid supply piping towards one or more heating, or reheat coils 12-0031, and returned through the heated fluid return piping towards one or more heating plants. The heated fluid is conveyed through the heated fluid piping via one or more pumping units contained in the heating plant.

A direct expansion (DX) refrigerant cooling coil 12-0024 and system is added to the cooling recovery coil system to provide air that has been dehumidified to a greater extent. This DX system is equipped with heat rejection systems 12-0330, 12-0340 that will reject the heat to atmosphere, or alternately the heat is rejected into the chilled water return system through pipes 12-0300, 12-0310, by use of a pumping system 12-0320, or a heat recovery system through pipes 12-0360, 12-0370, by use of a pumping and control valve system 12-0350, 12-0355. The compressor system 12-0380 discharges refrigerant into the heat rejection system or systems 12-0330, 12-0340. The condensed refrigerant is carried through refrigerant piping systems 12-0332, 12-0335 to and from the refrigeration coil 12-0024.

The rejected heat is used to heat water, or some other heat transfer fluid, that is utilized in a radiant heating system, a pool heating system, a domestic water heating system or any other system that requires heat of the quality level that is provided by the compressor/heat recovery system. The capacity of the compressor system 12-0380 is varied as required to provide the proper temperature and dehumidification level of the discharge air 12-0025. Once the air 12-0025 leaves the DX cooling coil 12-0024, the remainder of the process can occur as described in the following paragraphs.

The flow of chilled fluid to an AHU 12-0003 is controlled by selectively modulating a flow control valve 12-0055. The cooling recovery coil source fluid is controlled by selectively modulating flow control valves, 12-0081, 12-0055. The heating source fluid is controlled by selectively modulating flow control valves, not shown in this figure. The chilled fluid flow control valves 12-0055, 12-0081 are positioned downstream of respective AHUs 12-0003. Alternatively, however, the valves 12-0055, 12-0081 may be situated upstream of an AHU 12-0003 or upstream of the cooling recovery coils 12-0030 respectively.

Chilled fluid is used to condition air or to remove heat from one or more other sources. For example, chilled water is distributed through cooling coils 12-0015 or other heat exchange units of an AHU 12-0003. Fans 12-0060 or blowers can receive unconditioned or partially conditioned air from an inlet source consisting of return air 12-0002 and fresh air 12-0005 mixed in varying proportions to create a mixed air stream 12-0010, and deliver the mixed air stream 12-0010 through one or more cooling coils 12-0015. The mixed air stream 12-0010 can either be passed through a filtration system 12-0100 or it can be unfiltered.

As air moves past the cooling coils 12-0015, chilled fluid therein removes heat from the unconditioned or partially conditioned air. When mixed air 12-0010, or conditioned space conditions 12-0171 require it, the conditioned air 12-0025 leaving the cooling 'coils 12-0015 is cooled to where water is removed from the air and the relative humidity in the conditioned spaces is maintained low enough to reduce the potential for biological growth. Reducing the temperature of the conditioned air 12-0025 will condense moisture from the air, drying it out. Thus, dry, cold conditioned air 12-0025 is delivered to individual offices, rooms or other locations within a facility's interior 12-0171 through a discharge duct 12-0020, or other conveyance system.

The dry, cold conditioned air 12-0025 may be too cold to meet comfort needs or process cooling loads for many of the spaces that require cooling and dehumidification, so the conditioned air 12-0025 is passed through a cooling recovery coil system 12-0030. Warm fluid from the chilled water return piping 12-0051 leaving the cooling coil system 12-0015 is used to add heat to the air to reduce the need for heat from other heating sources, or to meet the need for re-heat in it's entirety. If the leaving air temperature is not raised adequately to meet the needs of the area or process load, warm or hot fluid is used to condition air or to add heat to the air from one or more heating sources by sending this warm fluid through a reheat coil system 12-0031.

To recapture the cooling from the cooling coil using the cooling recovery coil, a higher temperature heating source is introduced and used to add heat to the air entering the reheat coil system 12-0031. For example, heated water can be distributed through heating coils 12-0031 or other heat exchange units of a temperature control zone, 12-0065. The temperature control zone, 12-0065 includes a control system that controls the control valves not shown in this figure, which in turn which controls the source, volume or pressure of the heated source fluid that is passed through the heating coil 12-0031. Heated fluid is generated in a heating plant or plants and distributed to the temperature control zones, 12-0065 through heating fluid supply and return piping. The supply air temperature that leaves the heating coil 12-0031, and enters the spaces to be conditioned either directly or through a distribution system 12-0170, is continuously varied to maintain the needs of the occupant or process cooling loads 12-0171 by selectively modulating a flow control valve to add heat to the cold dry dehumidified air.

As a result of the heat exchange occurring at the cooling coils in a cooling recovery coil system 12-0015, the temperature of the fluid passing therethrough increases to approximately 65° F. to 75° F. or higher during the summer months. This heated or spent chilled fluid is collected in a separate spent fluid piping 12-0050, and delivered to the inlet of the chiller system. Or, if there is a need for re-heating of some or all of the air that has been cooled and dehumidified, some or all of the heated or spent chilled fluid that has been collected in the separate spent fluid piping is forced into the cooling recovery coil chilled water piping 12-0106, by operating the control valves 12-0081 and forcing the warm chilled water return into the cooling recovery coil heating water supply lines 12-0106, for delivery to the cooling recovery coils as the heating source for the cooling recovery coils.

Heated fluid is generated in a heating plant or plants and distributed to the temperature control zones 12-0065 through heating fluid supply and return piping, not shown in this figure. The supply air temperature that leaves the heating coil 12-0031 enters the spaces to be conditioned, either directly or through a distribution system 12-0170. The supply air temperature is continuously varied to maintain the needs of the occupant or process cooling loads 12-0171 by selectively modulating a flow control valve not shown in this figure to add additional heat to the cold dry dehumidified air.

The dry, cold conditioned air 03-0025 may be too cold to meet comfort needs or process cooling loads for many of the spaces that require cooling and dehumidification, so the conditioned air 12-0025 is passed through the cooling recovery coil 12-0030 to add heat to the air and warm it up. The air is then delivered to temperature control boxes 12-0065 that contain a heating coil 12-0031. If the space conditions or process cooling loads 12-0171 require air that is warmer than that which is provided after leaving the cooling recovery coil 12-0030, the reheat coil 12-0031 is activated. Warm or hot fluid is used to condition air or to add heat to the air from one or more heating sources. For example, heated water can be distributed through heating coils 12-0031 or other heat exchange units of a temperature control box 12-0065. The temperature control box 12-0065 includes a controller that controls the control valve not shown in this figure, which in turn controls the volume or pressure of the heated source fluid that is passed through the heating coil 12-0031.

Heated fluid is generated in a heating plant or plants not shown in this figure and distributed to the temperature control zones 12-0065 through heating fluid supply and return piping not shown in this figure. The supply air temperature that leaves the heating coil 12-0031 enters the spaces to be conditioned, either directly or through a distribution system 12-0170. The supply air temperature is continuously varied to maintain the needs of the occupant or process cooling loads 12-0171 by selectively modulating a flow control valve not shown in this figure to add heat to the cold dry dehumidified air.

Figure 13:
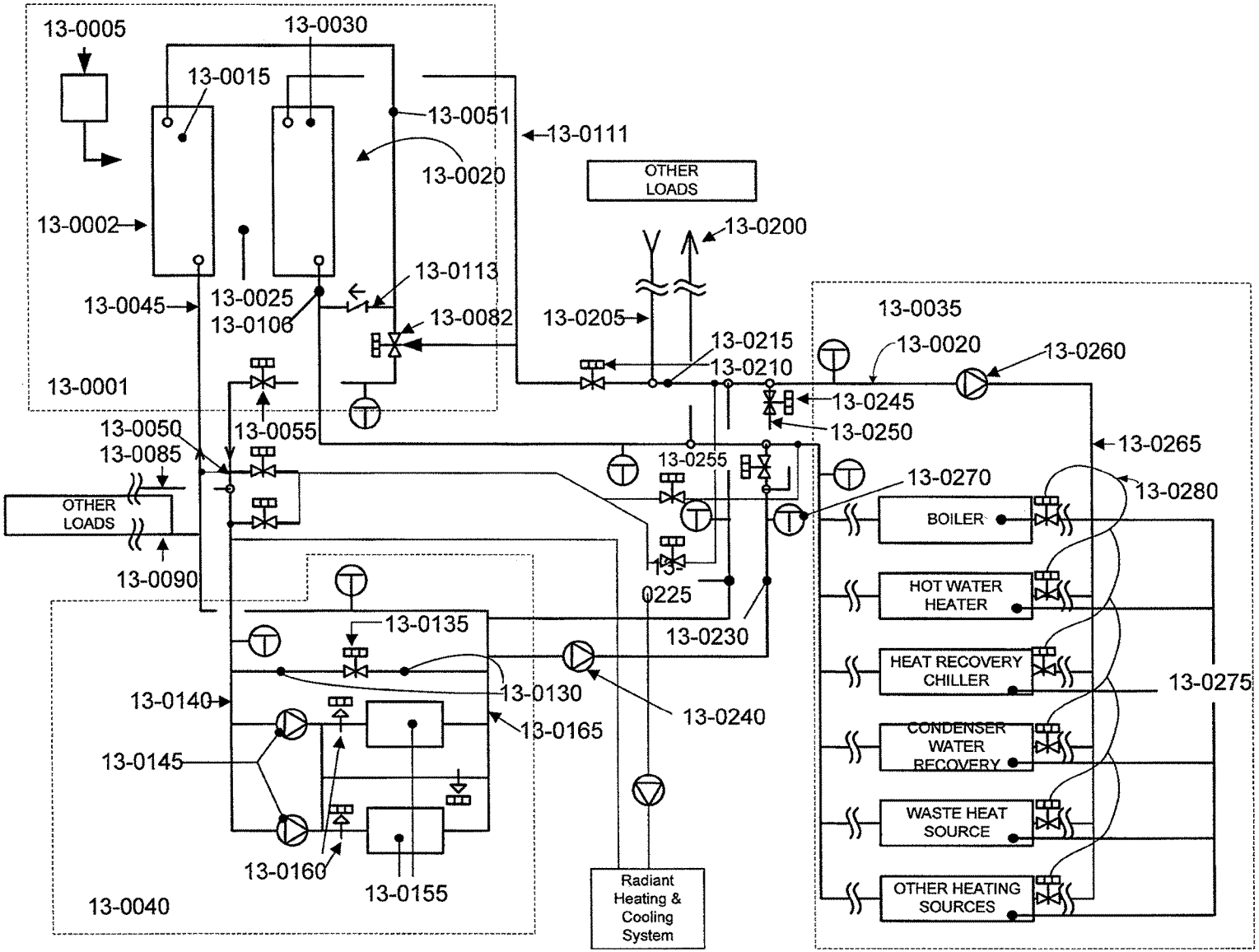
FIG. 13 is a schematic illustration of a cooling recovery coil system in accordance with yet another implementation.

FIG. 13 depicts an implementation in which the cooling coil system and the cooling recovery coil system can both be used as cooling coils to meet peak day cooling loads, while chiller plant efficiency is improved by using warmer chilled water temperatures due to the increased heat transfer surface area. Additionally, the cooling coil system and cooling recovery coil system can both be used as heating coils to meet peak heating loads while improving hot water plant efficiency by allowing the use of cooler heating water temperatures due to the increased heat transfer surface area. The cooling recovery system re-heat coil is connected to an auxiliary heating source to provide heating to the area being served when the need for heating exceeds that which is otherwise available from the fluid leaving the cooling coil. This implementation is very similar to FIG. 7, and includes the addition of a radiant heating and cooling system.

As shown in FIG. 13 a cooling, dehumidification and re-heat system 13-0001 includes one or more heat transfer systems 13-0015, 13-0030, valves 13-0055, 13-0082 and the like. Fluid is cooled in a chiller system 13-0040 and conveyed through a chilled fluid supply piping 13-0045, 13-0090 towards one or more AHUs 13-0003, and returned through the chilled fluid return piping 13-0050, 13-0085 towards one or more chiller systems 13-0040. The cooled fluid is conveyed through the chilled fluid piping via one or more pumping units contained in the chiller systems 13-0040. Fluid is heated in a heating plant 13-0035 and conveyed through a heated fluid supply piping 13-0075, 13-0105, 13-0106, 13-0200 towards one or more heating, reheat or cooling recovery coils 13-0030, and returned through the heated fluid return piping 13-0070, 13-0111, 13-0205 towards one or more heating plants 13-0035. The heated fluid is conveyed through the heated fluid piping via one or more pumping units contained in the heating plants 13-0035.

The flow of chilled fluid to cooling coils 13-0015 for heat transfer is controlled by selectively modulating a flow control valve 13-0055. The heating source fluid is controlled by selectively modulating flow control valve, 13-0082. The chilled fluid flow control valves 13-0055 are positioned downstream of cooling coils 13-0015. The heating source fluid flow control valves 13-0082 are positioned downstream of respective heating coils (cooling recovery coils) 13-0030. Alternatively, however, the valves 13-0055, 13-0082 may be situated upstream of cooling coils 13-0015 or upstream of the heating coils (cooling recovery coils) 13-0030 respectively.

Chilled fluid is used to condition air or to remove heat from one or more other sources. For example, chilled water can be distributed through cooling coils 13-0015 or other heat exchange units of an AHU. Fans or blowers can receive unconditioned or partially conditioned air from an inlet source consisting of return air 13-0002 and fresh air 13-0005 mixed in varying proportions to create a mixed air stream and deliver the mixed air stream through one or more of the cooling coils 13-0015.

As air moves past the cooling coils 13-0015 in cooling recovery coil system, chilled fluid therein removes heat from the unconditioned or partially conditioned air. When mixed air or conditioned space conditions require it, the conditioned air 13-0025 leaving the cooling coils 13-0015 is cooled to where water is removed from the air and the relative humidity in the conditioned spaces is maintained low enough to reduce the potential for biological growth. Reducing the temperature of the conditioned air 13-0025 will condense moisture from the air, drying it out. Thus, dry, cold conditioned air 13-0025 is delivered to individual offices, rooms or other locations within a facility's interior through a discharge duct or other conveyance system.

The dry, cold conditioned air 13-0025 will typically be too cold to meet comfort needs or process cooling loads for many of the spaces that require cooling and dehumidification, so the conditioned air 13-0025 is passed through a cooling recovery coil system 13-0030. Warm fluid that is being sourced from the chilled water return piping 13-0051 that leaves the cooling coils 13-0015 is used to add heat to the air to reduce the need for heat from other heating sources, or to meet the need for re-heat in its entirety. If the leaving air temperature is not raised adequately to meet the needs of the area or process load, warm or hot fluid is used to condition air or to add heat to the air from one or more heating sources.

To augment the heating capacity available from the warm water leaving the cooling coils 13-0015, a higher temperature heating source is introduced. For example, heated fluid can be distributed through heating coils (cooling recovery coils) 13-0030 or other heat exchange units of an AHU. The AHU includes a control system that controls the control valves 13-0082, which in turn control the source, volume or pressure of the heated source fluid that is passed through the cooling recovery coil 13-0030.

Heated fluid is generated in a heating plant or plants 13-0035 and distributed to the AHU's through heating fluid supply piping 13-0075, 13-0105, 13-0106, 13-0210 and heating fluid return piping, 13-0070, 13-0111, 13-0205. The supply air temperature that leaves the heating coil (cooling recovery coil) 13-0030 and enters the spaces to be conditioned, either directly or through a distribution system is continuously varied to maintain the needs of the occupant or process cooling loads by selectively modulating a flow control valve 13-0082 to add heat to the cold dry dehumidified air.

As a result of the heat exchange occurring at the cooling coils 13-0015, the temperature of the fluid passing therethrough increases to approximately 65° F. to 75° F. or higher during the summer months when dehumidification loads are typically present. This heated or spent chilled fluid is collected in a separate spent fluid piping 13-0050, 13-0051, 13-0085 and delivered to the inlet of the chiller system 13-0040. Or, if there is a need for re-heating some or all of the air that has been cooled and dehumidified, some or all of the heated or spent chilled fluid that has been collected in the separate spent fluid piping 13-0051 is forced into the cooling recovery coil chilled water piping 13-0106, 13-0107 by operating the control valves 13-0082, and forcing the warm chilled water return into the cooling recovery coil heating water supply lines 13-0106, 13-0107 for delivery to the cooling recovery coils as the heating source for the cooling recovery coils.

The main components within the chiller plant systems 13-0040 are as follows: 13-0140 is the chilled fluid return piping inside the chiller plant systems, and is the piping in which all of the various fluid streams mix and become one common fluid stream. The fluid is returned from the cooling loads imposed by the AHU's or process cooling loads through the chilled fluid piping 13-0085, 13-0050, mixed with the fluid returning from the cooling recovery coil systems, and the fluid from the bypass piping 13-0130. The mixed fluid is then drawn into the chilled fluid pumping systems 13-0145.

The chilled fluid pumping systems is provided in a draw-through or push-through configuration with the chillers 13-0155. The warm mixed fluid is then passed through the chiller systems 13-0155 where the fluid temperature is reduced. The chiller isolation valves 13-0160 are controlled to allow flow through the chillers that are operational. The chilled fluid then enters a common discharge piping 13-0165, where it is either delivered to the cooling loads through the supply piping 13-0090, 13-0045, or is returned to the chilled fluid return piping by passing through the chilled fluid bypass piping 13-0130 and bypass piping control valve 13-0135. While FIG. 13 illustrates one piping arrangement, other piping configurations can be used.

The main components within the heating plant systems 13-0035 are as follows: 13-0265 is the heated fluid return piping inside the heating plant systems, and is the piping where all of the various fluid streams mix and become one common fluid stream. The fluid is returned from the heating loads imposed by the AHU's or process loads through heated fluid piping 13-0020, 13-0215, 13-0205 mixed with the fluid returning from the cooling recovery coil systems, 13-0111, the fluid from heating/cooling crossover piping, 13-0225, 13-0230 and the fluid from the bypass piping 13-0250. The mixed fluid is then drawn into the heated fluid pumping systems 13-0260.

The heated fluid pumping systems is provided in a draw-through or push-through configuration with heaters 13-0275. The warm mixed fluid is then passed through the heater systems 13-0275 where the fluid temperature is increased. The heater isolation valves 13-0280 are controlled to allow flow through operational heaters. The heated fluid then enters a common discharge piping 13-0270 where it is either delivered to the heating loads through the supply piping 13-0075, 13-0105, or is returned to the heated fluid return piping by passing through the heated fluid bypass piping 13-0250 and bypass piping control valve 13-0245, 13-0255. FIG. 13 shows the heaters piped in one arrangement, although different arrangements are possible.

FIG. 13 shows one arrangement that includes the addition of a radiant heating and cooling system. The radiant heating and cooling system 13-0500, draws its source water through supply water piping 13-0520, 13-0720, 13-0610, and discharges the return water through return water piping 13-0530, 13-0710, 13-0730. Control valves 13-0700, 13-0600, 13-0800, 13-0810 are used to direct flow to and from either the cooling source or the heating source. Pumping system 13-0510 is used to provide flow to and from the radiant heating and cooling system from the cooling and heating sources.

Figure 14:
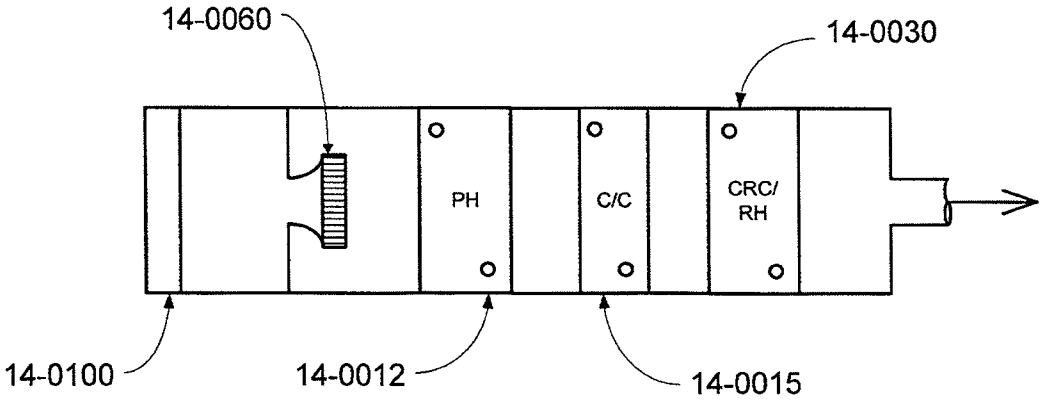
FIGS. 14-20 depict alternative layouts of equipment for a cooling system.

FIG. 14 depicts an alternative layout of a cooling system, including a filtration system, 14-0100, a fan or blower system, 14-0060, a pre-heat coil, 14-0012, a cooling coil, 14-0015, and a cooling recovery coil 14-0030. The cooling recover coil 14-0030 can also be used as a reheat coil in alternative implementations.

Figure 15:
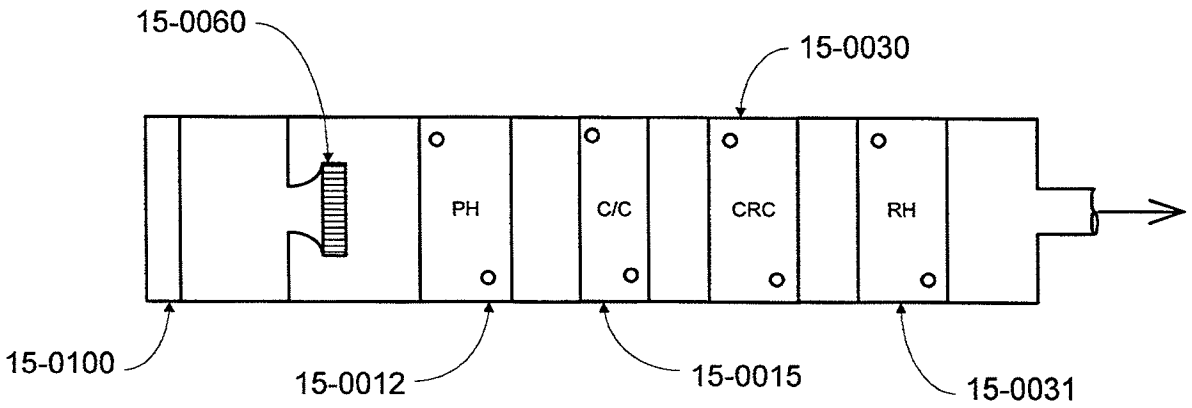

FIG. 15 depicts another alternative layout of a cooling system, including a filtration system, 15-0100, a fan or blower system, 15-0060, a pre-heat coil, 15-0012, a cooling coil, 15-0015, a cooling recovery coil 15-0030, and a reheat coil 15-0031.

Figure 16:
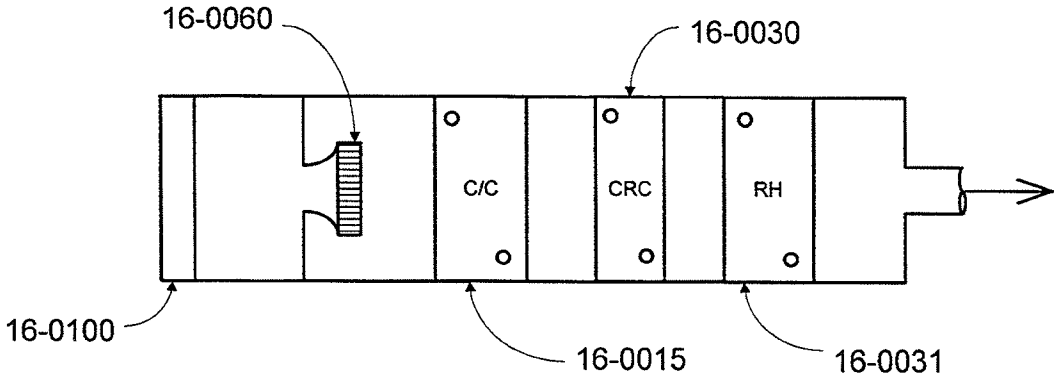

FIG. 16 depicts another alternative layout of a cooling system, including a filtration system, 16-0100, a fan or blower system, 16-0060, a cooling coil, 16-0015, a cooling recovery coil 16-0030, and a reheat coil 16-0031.

Figure 17:
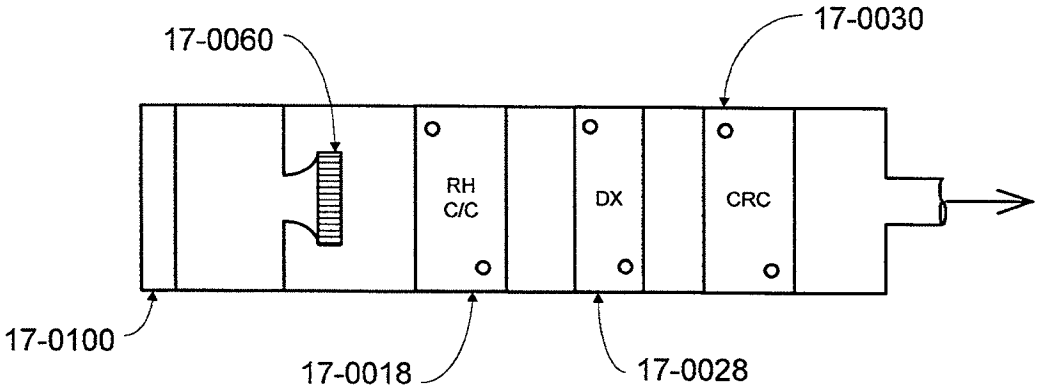

FIG. 17 depicts another alternative layout of a cooling system, including a filtration system, 17-0100, a fan or blower system, 17-0060, a pre-heat coil that can also be used as a cooling coil in some embodiments, 17-0018, and a cooling recovery coil 17-0030.

Figure 18:
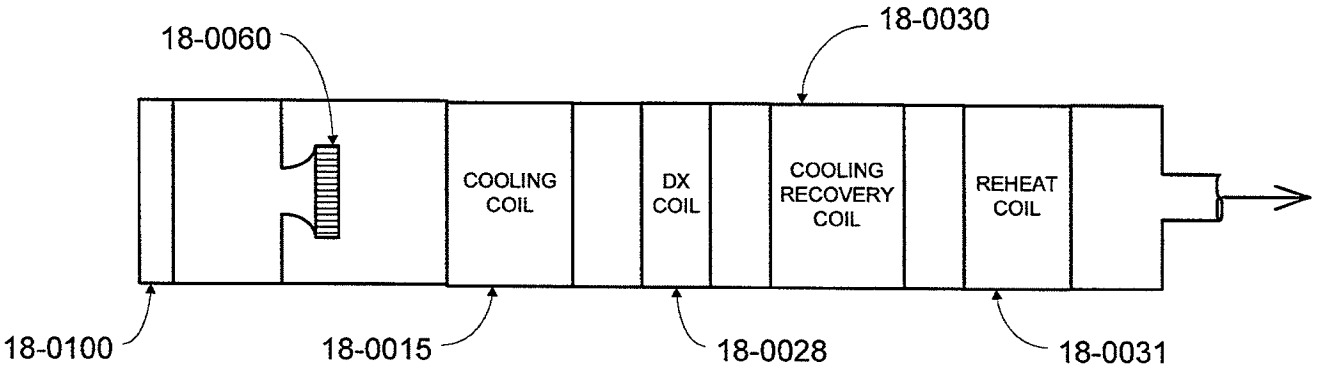

FIG. 18 depicts another alternative layout of a cooling system, including a filtration system, 18-0100, a fan or blower system, 18-0060, a pre-heat coil that can also be used as a cooling coil in some embodiments, 18-0018, a cooling recovery coil 18-0030, and a reheat coil 18-0031.

Figure 19:
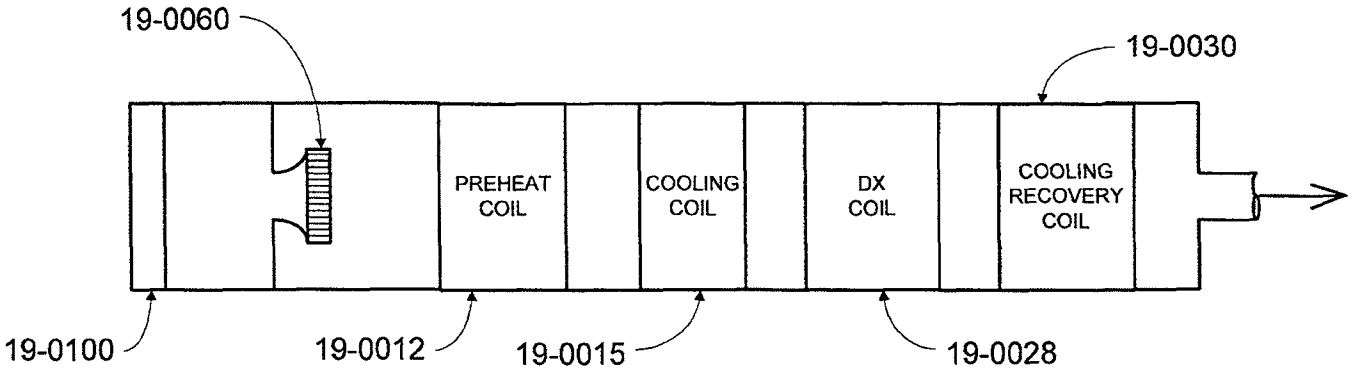

FIG. 19 depicts another alternative layout of a cooling system, including a filtration system, 19-0100, a fan or blower system, 19-0060, a pre-heat coil 19-0012, a cooling coil, 19-0015, a direct expansion cooling coil, 19-0028, and a cooling recovery coil 19-0030. The cooling recover coil 19-0030 can also be used as a reheat coil in alternative implementations.

Figure 20:
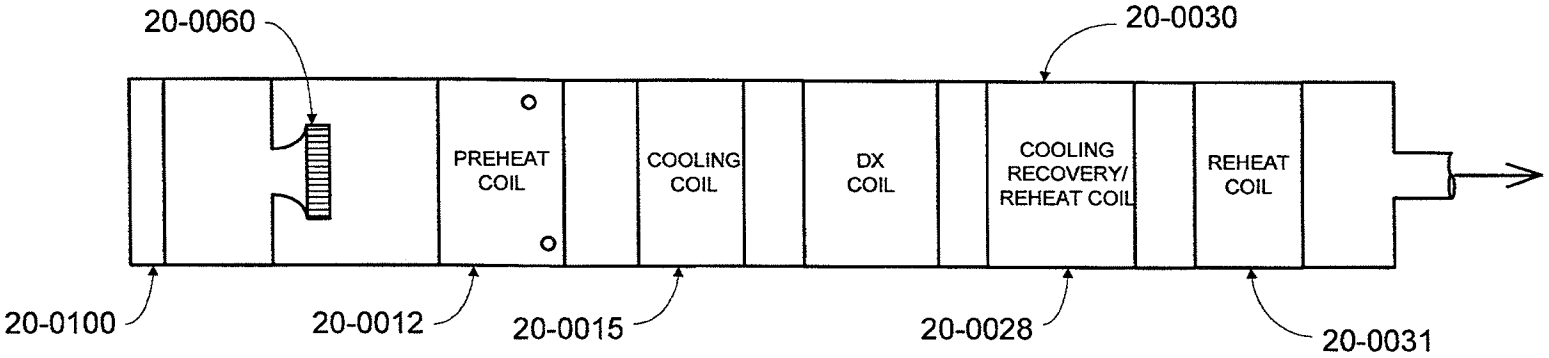

FIG. 20 depicts another alternative layout of a cooling system, including a filtration system, 20-0100, a fan or blower system, 20-0060, a pre-heat coil 20-0012, a cooling coil, 20-0015, a direct expansion cooling coil, 20-0028, a cooling recovery coil that can also be used as a reheat coil in some embodiments 20-0030, and a reheat coil 20-0031.

Spent (warm) chilled water return that is not required by the cooling recovery coils is delivered to the inlet of a chiller to be cooled and sent back out into the cooling system. As a result of the heat transfer from the unconditioned or partially conditioned air to the chilled water at or near the cooling coils, humidity is also removed from the air. The warm chilled water used in the cooling recovery coil system can re-heat the air, reducing the amount of new re-heat energy that is required. This also reduces the amount of cooling energy that is required, since the cold air draws heat from the water being returned to the chiller.

The cooling coils described with respect to some implementations above require a chilled fluid supply temperature of between 45° F. and 50° F. to meet peak cooling and dehumidification loads being supplied through chilled fluid piping from the chiller system. This is a higher temperature for the chilled water supply than typical designs, and helps to reduce chiller plant energy consumption by allowing increased chiller efficiencies. The chillers can be piped in series, rather than in parallel, further improving chiller efficiency. Chilled fluid supply temperature of less than 45° F. and greater than 50° F. can be used as cooling and dehumidification needs dictate.

The cooling coils described above can provide a chilled fluid return temperature of between 65° F. and 75° F. or higher, being returned to the chiller systems or being used as heating source water for the cooling recovery coil by moving the water through cooling recovery coil piping. The higher chilled fluid return temperature that leaves the cooling coils in a cooling recovery coil system allows this warm fluid as a heating source for the cooling recovery coils.

Except where noted, in the implementations described above the cooling coils provide a discharge air temperature of between 50° F. and 55° F., as required to meet comfort needs or the needs of the process cooling loads. A maximum discharge air temperature of approximately 55° F. is used when dehumidification is required to reduce the amount of water contained in the air stream that enters the conditioned spaces. Discharge air temperature of less than 50° F. and greater than 55° F. can be used in different system embodiments, and as cooling and dehumidification needs dictate.

The cooling coils described above are preferably sized with a face velocity of 200 to 600 feet per minute, and preferably 250 to 450 feet per minute, although lower or higher face velocities can be used. The cooling coils are sized with between six and ten rows, but a greater or lower number of rows can also be used. The heating coils described above are preferably sized with a face velocity of 200 to 500 feet per minute, but may have higher or lower coil face velocities. The heating coils include between two and six rows of heat transfer tubing, but higher or lower row counts can also be used.

During the heating season for a facility, the heating coils (cooling recovery coils) require a heated fluid supply temperature of approximately 80° F. and 120° F. supplied through the heated fluid piping from the heating plants. This is a lower heating water supply temperature than typical designs and helps to reduce heating plant energy consumption by allowing increased hot water heater or boiler efficiencies.

Also during the heating season, the heating coils (cooling recovery coils) provide a heated fluid return temperature of between 60° F. and 90° F., being returned through the heated fluid piping to the heating plants. The heating coils (cooling recovery coils) provide a discharge air temperature of between 70° F. and 110° F., as required to meet comfort needs or the needs of the process heating loads. A maximum discharge air temperature of approximately 110° F. is used to reduce the amount of hot air stratification that occurs when the heated air enters the conditioned space or process load, but higher or lower temperatures can be used as dictated by the application.

During the cooling season for the facility, when the cooling recovery process is optimally used, the heating coils (cooling recovery coils) require a heated fluid supply temperature of approximately 62° F. and 75° F. supplied through the heated fluid piping from the cooling recovery piping. The heating coils (cooling recovery coils) provide a discharge air temperature of between 58° F. and 72° F., as required to meet comfort needs or the needs of the process heating loads. During the cooling season, there is usually a low need for heating, so the supply air temperature can be lower, allowing the use of the cooling recovery coil as the heating source.

Also during the cooling season, the heating coils (cooling recovery coils) provide a heated fluid return temperature of between 58° F. and 65° F., being returned through the heated fluid piping and the cooling recovery piping to the chiller plant systems. The cooling recovery coil system removes cooling load from the chiller plant by reducing the water temperature that is returned to the chiller, and reduces the need for new source energy for the re-heat system by warming the air up.

Although a few embodiments have been described in detail above, other modifications are possible. Other arrangements, implementations and alternatives may be within the scope of the following claims.

What is claimed is:

1. An air conditioning system comprising:

a cooling coil having an inlet to receive fluid at a first temperature from a fluid chiller to cool and dehumidify air that passes over the cooling coil, and having an outlet to output spent fluid at a second temperature, the second temperature being greater than the first temperature due to heat exchange from the air to the fluid occurring during the cooling and de-humidifying of the air, the cooling coil being sized to have a cooling coil face velocity for the air passing over the cooling coil in a first range of at least approximately 10 feet per minute;

a cooling recovery coil having an inlet to receive the spent fluid, the cooling recovery coil configured to cause heat exchange from the spent chilled fluid to the air previously passed over and cooled and dehumidified by the cooling coil as the air passes over the cooling recovery coil, the heat exchange caused by the cooling recovery coil resulting in cooling of the spent fluid to a third temperature before the spent fluid is returned to the fluid chiller, the third temperature being less than the second temperature, the cooling recovery coil being sized to have a cooling recovery coil face velocity for the air passing over the cooling recovery coil in a second range of at least approximately 10 feet per minute;

an additional heat exchange coil configured to cause heat exchange with the air that previously passed over the cooling coil and the cooling recovery coil; and a control system configured to control a plurality of control valves such that:

operation of the cooling coil results in the air passing over the cooling coil achieving a supply air temperature sufficiently low to cause dehumidification while raising the second temperature of the spent fluid;

wherein a cooling demand on the fluid chiller is reduced.

2. The air conditioning system of claim 1, wherein the cooling coil comprises at least 9 rows of cooling coils.

3. The air conditioning system of claim 1, wherein the cooling coil comprises 9 or 10 rows of cooling coils, 4 to 6 rows of cooling coils, 6 to 10 rows of cooling coils, or at least 10 rows of cooling coils.

4. The air conditioning system of claim 1, wherein the first range is approximately 250 to 450 feet per minute, 500 to 600 feet per minute, 800 to 1000 feet per minute, 200 to 600 feet per minute, or less than 250 feet per minute.

5. The air conditioning system of claim 1, wherein the cooling recovery coil comprises at least 3 rows of heat transfer tubing.

6. The air conditioning system of claim 1, wherein the cooling recovery coil comprises between 3 and 6 rows of heat transfer tubing.

7. The air conditioning system of claim 1, further comprising:

a preheat coil and a direct expansion coil disposed on opposing sides of the cooling coil, the direct expansion coil and the preheat coil disposed on opposing sides of the cooling recovery coil.

8. An air conditioning system comprising:

a cooling coil having an inlet to receive fluid at a first temperature from a fluid chiller to cool and dehumidify air that passes over the cooling coil, and having an outlet to output spent fluid at a second temperature, the second temperature being greater than the first temperature due to heat exchange from the air to the fluid occurring during the cooling and de-humidifying of the air, the cooling coil comprising at least 1 row of cooling coils;

a cooling recovery coil having an inlet to receive the spent fluid, the cooling recovery coil configured to cause heat exchange from the spent chilled fluid to the air previously passed over and cooled and dehumidified by the cooling coil as the air passes over the cooling recovery coil, the heat exchange caused by the cooling recovery coil resulting in cooling of the spent fluid to a third temperature before the spent fluid is returned to the fluid chiller, the third temperature being less than the second temperature, the cooling recovery coil comprising at least 1 row of heat transfer tubing;

an additional heat exchange coil configured to cause heat exchange with the air that previously passed over the cooling coil and the cooling recovery coil; and a control system configured to control a plurality of control valves such that:

operation of the cooling coil results in the air passing over the cooling coil achieving a supply air temperature sufficiently low to cause dehumidification while raising the second temperature of the spent fluid;

wherein a cooling demand on the fluid chiller is reduced.

9. The air conditioning system of claim 8, the cooling coil being sized to have a cooling coil face velocity for the air passing over the cooling coil in a first range of approximately between 200 to 500 feet per minute, 500 to 600 feet per minute, 800 to 1000 feet per minute, 200 to 600 feet per minute, or less than 250 feet per minute.

10. The air conditioning system of claim 8, the cooling recovery coil being sized to have a cooling recovery coil face velocity for the air passing over the cooling coil in a second range of approximately between 200 to 500 feet per minute, 500 to 600 feet per minute, 800 to 1000 feet per minute, 200 to 600 feet per minute, or less than 250 feet per minute.

11. The air conditioning system of claim 8, further comprising:

a preheat coil disposed in front of the cooling coil.

12. The air conditioning system of claim 11, further comprising: a direct expansion coil disposed on another side of the cooling coil.

13. The air conditioning system of claim 8, further comprising a reheat coil having an inlet to receive a heated fluid supply, the reheat coil configured to cause heat exchange between the air previously heated by the cooling recovery coil resulting in additional heating of the air from the cooling recovery coil.

14. An air conditioning system comprising:

a cooling coil having an inlet to receive fluid at a first temperature from a fluid chiller to cool and dehumidify air that passes over the cooling coil, and having an outlet to output spent fluid at a second temperature, the second temperature being greater than the first temperature due to heat exchange from the air to the fluid occurring during the cooling and de-humidifying of the air;

a cooling recovery coil having an inlet to receive the spent fluid, the cooling recovery coil configured to cause heat exchange from the spent chilled fluid to the air previously passed over and cooled and dehumidified by the cooling coil as the air passes over the cooling recovery coil, the heat exchange caused by the cooling recovery coil resulting in cooling of the spent fluid to a third temperature before the spent fluid is returned to the fluid chiller, the third temperature being less than the second temperature;

an additional heat exchange coil configured to cause heat exchange with the air that previously passed over the cooling coil and the cooling recovery coil; and a control system configured to control a plurality of control valves such that:

operation of the cooling coil results in the air passing over the cooling coil achieving a supply air temperature sufficiently low to cause dehumidification while raising the second temperature of the spent fluid;

wherein a cooling demand on the fluid chiller is reduced; and wherein at least the cooling coil and the cooling recovery coil are disposed in a single unit.

15. The air conditioning system of claim 14, wherein the cooling coil comprises at least 9 rows of cooling coils.

16. The air conditioning system of claim 14, wherein the cooling coil comprises 9 or 10 rows of cooling coils, 4 to 6 rows of cooling coils, 6 to 10 rows of cooling coils, or at least 10 rows of cooling coils.

17. The air conditioning system of claim 14, the cooling coil being sized to have a cooling coil face velocity for the air passing over the cooling coil in a first range of approximately 200 to 500 feet per minute, 500 to 600 feet per minute, 800 to 1000 feet per minute, 200 to 600 feet per minute, or less than 250 feet per minute.

18. The air conditioning system of claim 14, wherein the cooling coil is sized to have a face velocity between 250 and 450 feet per minute.

19. The air conditioning system of claim 14, wherein the cooling recovery coil comprises at least 3 rows of heat transfer tubing.

20. The air conditioning system of claim 14, wherein the cooling recovery coil comprises between 3 and 6 rows of heat transfer tubing.

21. The air conditioning system of claim 14, the cooling recovery coil being sized to have a cooling recovery coil face velocity for the air passing over the cooling recovery coil in a second range of approximately 200 to 500 feet per minute, 500 to 600 feet per minute, 800 to 1000 feet per minute, 200 to 600 feet per minute, or less than 250 feet per minute.

22. The air conditioning system of claim 14, further comprising:

a preheat coil and a direct expansion coil disposed on opposing sides of the cooling coil, the direct expansion coil and the reheat coil disposed on opposing sides of the cooling recovery coil.

* * * * *